US005480131A

United States Patent [19]

Furukawa et al.

[11] Patent Number: 5,480,131

[45] Date of Patent: Jan. 2, 1996

[54] PAPER FEEDING DEVICE

[75] Inventors: Hideaki Furukawa; Tadashi Yamakawa, both of Yokohama, Japan

[73] Assignee: Canon Kabushiki Kaisha, Tokyo, Japan

[21] Appl. No.: 117,655

[22] Filed: Sep. 8, 1993

Related U.S. Application Data

[63] Continuation of Ser. No. 642,562, Jan. 18, 1991, abandoned, which is a continuation of Ser. No. 198,588, May 23, 1988, abandoned, which is a continuation of Ser. No. 894,744, Aug. 11, 1986, abandoned, which is a continuation of Ser. No. 544,410, Oct. 21, 1983, abandoned.

[30] Foreign Application Priority Data

| | | | |
|---|---|---|---|
| Jan. 25, 1982 | [JP] | Japan | 57-187181 |
| Jan. 25, 1982 | [JP] | Japan | 54-187182 |
| Oct. 25, 1982 | [JP] | Japan | 57-186072 |
| Oct. 25, 1982 | [JP] | Japan | 57-186073 |
| Oct. 25, 1982 | [JP] | Japan | 57-186074 |
| Oct. 25, 1982 | [JP] | Japan | 57-187178 |
| Oct. 25, 1982 | [JP] | Japan | 57-187179 |
| Oct. 25, 1982 | [JP] | Japan | 57-187180 |
| Oct. 25, 1982 | [JP] | Japan | 57-187183 |
| Oct. 25, 1982 | [JP] | Japan | 57-187184 |

[51] Int. Cl.[6] ..... B65H 3/44

[52] U.S. Cl. ..... 271/9.06; 271/145; 271/265.02

[58] Field of Search ..... 271/110, 111, 271/10, 152, 153, 156, 1, 164, 9, 258, 259, 161, 170, 171, 34, 155, 160, 227, 126, 9.06, 145, 265.02

[56] References Cited

U.S. PATENT DOCUMENTS

| | | | |
|---|---|---|---|
| 3,575,410 | 4/1971 | Suzuki | 271/111 |
| 3,592,464 | 7/1971 | Kanda | 271/171 |
| 3,655,183 | 4/1972 | Wagner | 271/155 |
| 3,741,357 | 6/1973 | Krysiuk et al. | 271/227 |
| 3,768,806 | 10/1973 | Reehil | 271/155 |
| 3,804,512 | 3/1974 | Komori et al. | 271/160 |
| 4,025,187 | 5/1977 | Taylor et al. | 271/34 |
| 4,032,137 | 6/1977 | Katayama et al. | 271/160 |
| 4,077,620 | 3/1978 | Funk et al. | 271/259 |
| 4,253,654 | 3/1981 | Buy | 271/155 |
| 4,310,153 | 1/1982 | Kikuchi | 271/111 |
| 4,332,375 | 6/1982 | Tsubo | 271/155 |
| 4,478,508 | 10/1984 | Kato et al. | 271/152 |

FOREIGN PATENT DOCUMENTS

| | | | |
|---|---|---|---|
| 2063540 | 7/1971 | Germany . | |
| 0010028 | 1/1977 | Japan | 271/126 |
| 1331457 | 9/1973 | United Kingdom . | |

OTHER PUBLICATIONS

IBM Technical Disclosure Bulletin, vol. 20, No. 5 Oct. 1977, Paper Stack Height Control.

*Primary Examiner*—Richard Hjerpe
*Assistant Examiner*—Steven J. Saras
*Attorney, Agent, or Firm*—Fitzpatrick, Cella, Harper & Scinto

[57] ABSTRACT

A paper feeding device for a printer, a copying machine or the like is detachable therefrom and need not be electrically connected thereto. The device has a lifter or deck to store a large number of paper sheets thereon, transfer rollers for transferring paper sheets, a lifter motor for vertically moving the lifter, sensors for detecting the position of the lifter, paper size, the no paper sheet state, etc., and a microcomputer to control the transfer timing of the paper sheet. The device allows continuous copying or printing without frequent interruption for replenishment of paper sheets or interruption due to incorrect detection of abnormal operation.

10 Claims, 34 Drawing Sheets

| FIG. 9A | FIG. 9B | FIG. 9C |
|---|---|---|

DCTL
DOWN CONTROL
1070
FLICKER MODE SET
1071
JAM RESET
1072

1073
LAMP AND SL2. ON

1074
M2 OFF
1075
MID PLATE UP ?
YES
NO
1076
LOW LEVEL ?
YES
NO
1077
SL3 ON ?
YES
NO
1078
190ms WAIT
SL3 ON
1078
M1 ON ?
YES
1080
NO
1081
M1 ON DWN ON
1082
10 SEC ABNORMALITY TIMER SET
TITMC
M1 OFF ABNORMALITY TIMER RESET
1083
1084
SL3 OFF ?
YES
NO
1085
350ms WAIT
SL3 SL2 OFF
1086

125
+10V
Vss
PA0
PA1
PA2
INT
PE0
PE1
PE2
PF0
PF1
PB0
PB1
PB2
PE3
PB3
PF3 PF2
CL0
CL1
VGG
132
109
141
138
+24V
133
134
139
111
M
137
135
118
140
136
120
102A
102
129
+24A
128
131
130
502C
502B
502A
126
127
503A
501A
501AP
501AL
503B
501BP
501BL
501B
110

PAPER FEEDING DEVICE

This application is a continuation of application Ser. No. 07/642,562 filed Jan. 18, 1991, now abandoned; which is a continuation of application Ser. No. 07/198,588 filed May 23, 1988, abandoned; which is a continuation of application Ser. No. 06/894,744 filed Aug. 11, 1986, abandoned; which is a continuation of application 06/544,410 filed Oct. 21, 1983, abandoned.

BACKGROUND OF THE INVENTION

1. Field of the Invention

The present invention relates to a paper feeding device for feeding paper sheets stacked on a vertically movable lifter.

2. Description of the Prior Art

In image recording apparatuses such as electrographic or xerographic copying machines or simple printers, paper sheets are generally fed by a method adopting paper cassettes. According to this method, a paper cassette containing paper sheets cut to predetermined lengths is inserted in a cassette insertion port of an image recording apparatus. The paper sheets stored in the cassette are individually fed into the apparatus by a paper feeding means and are supplied to an image recording section. When paper cassettes for separately storing paper sheets of different sizes, quality or the like are prepared, paper sheets to be supplied to the image recording apparatus may be easily switched by inserting or dismounting the cassettes. Alternatively, a plurality of cassettes storing paper sheets of different sizes can be mounted in a plurality of cassette insertion ports of an image recording apparatus, and the size of paper sheets to be fed to the apparatus may be switched by operation of a selection button.

However, a paper cassette can only store a maximum of, for example, 250 or 500 paper sheets. When a large number of copies such as, for example, 1,000 or 2,000 copies are to be reproduced continuously, paper replenishment must be performed several times during the copying operation, thus requiring frequent interruption of the copying operation. Due to such frequent paper replenishment, the recording apparatus cannot be used to its maximum capacity.

In view of this problem, some high-speed, high-quality recording apparatuses incorporate a deck (or tray) mechanism for storing a large number of paper sheets, for example, 1,000 paper sheets, and feeding these paper sheets. However, such a deck mechanism is usually built into the apparatus. Even if such a deck mechanism is detachable from the apparatus, signal lines and the like must be connected. Thus, the deck mechanism can only be used for an image recording apparatus for which it is designed, and cannot be used as a general purpose machine.

When individual paper sheets are individually supplied (fed or picked up hereinafter) from the paper feeding device to a main apparatus such as a printer, picking up of the paper sheets may be performed abnormally due to contact pressure between a or pickup roller and the paper sheets. For example, a paper feeding device is known wherein a large number of paper sheets are stacked on a paper lifter, and the position of the lifter is detected whereat the uppermost paper sheet on the lifter contacts the pickup roller with a constant pressure, thereby raising the lifter in accordance with the detection result obtained. In such a paper feeding device, picking up of a paper sheet may be performed even while the lifter is being raised. However, the operation of picking up only the uppermost paper sheet is greatly influenced by the surrounding physical conditions such as the presence/absence of vibration, the contact pressure between the pickup roller and the paper sheet, and the like. For this reason, reliable picking up of the paper sheets while the lifter is being raised is difficult, and erratic operation tends to occur.

A drive motor for a conventional vertically movable lifter is generally an AC motor. However, such an AC motor is bulky and renders the feeding device large in size. In addition to this, when the time difference between the stop time of the motor in the up control and that in the down control is large, and when fixing of the rotating shaft of the motor has as a reference the stop time of the motor in the down control, the rotating shaft is fixed after the motor is stopped and before the lifter begins to move downward. This results in a low fixed position precision and in degradation of or damage to the fixing device.

Furthermore, in a vertically movable lifter of this type, abnormal upward movement of the lifter is often detected. However, conventionally, when an abnormal upward movement of the lifter is detected, control operation of the lifter is simply terminated. For this reason, the lifter stops due to an abnormality such as flapping of the paper sheet, formation of a paper loop and the like, thereby interrupting processing for copying. If extra capability is to be built in the device so as to detect such flapping of the paper sheet, formation of a paper loop or the like without erratically interrupting control operation of the lifter, the feed efficiency of the device is impaired.

Detection of an abnormal upward movement of the lifter is generally performed using only switching contacts. The power source such as a motor for vertically moving the lifter is interrupted by the operation of the switch. Accordingly, if the switch operates erratically even when the motor is not driving the lifter to move it upward, the abnormality detecting means detects an abnormality, and again interrupts processing of the copying operation.

When a paper sheet fed from a lifter is to be stopped on a transfer section of the paper feed device, the stop position of the sheet is determined by a paper leading end sensor such as a switch which is located at a position corresponding to the leading end of a paper sheet properly stopped at the stop position. When a roller or the like of an image recording apparatus or the like is placed at the leading end side of the paper sheet being fed and the paper sheet must be properly brought into contact with the roller to be transferred thereby, correct transfer stop timing is hard to determine. The position of the trailing end of the paper sheet is also hard to determine. For these reasons, a second paper sheet can be fed only after a first paper sheet is completely fed into the recording apparatus or the like.

In a paper feeding device having a paper position sensor at a position corresponding to the trailing end of the fed paper sheet, a number of sensors must be incorporated to correspond to the number of different sizes of paper sheets which may be fed by the device, since the position of the trailing end of the paper sheet differs in accordance with the paper size.

Furthermore, since the stop position of a paper sheet is set with reference to an end of the paper sheet, the stop position cannot be determined with reference to a central portion of the paper sheet.

When a cassette storing a large number of paper sheets is mounted in place of a general cassette at a cassette mounting position, the copying machine performs display and control operations in accordance with the size of the paper sheets fed. For this reason, in order to perform normal copying the size of the paper sheets fed must be transmitted to the copying machine.

SUMMARY OF THE INVENTION

The present invention has been made in consideration of this, and has for its object to provide a high-performance paper feeding device which is capable of performing reliable paper feeding.

It is another object of the present invention to provide a paper feeding device which is capable of performing paper feeding operation without being electrically connected to an image recording apparatus, and which is, therefore, a general purpose device.

It is still another object of the present invention to provide a paper feeding device which can reliably detect an abnormal upward movement of a lifter for storing paper sheets thereon.

It is still another object of the present invention to provide a paper feeding device which moves the lifter downward upon detecting an abnormal upward movement of the lifter, thereby self-correcting erratic paper feed operation.

It is still another object of the present invention to provide a paper feeding device which is capable of stopping a paper sheet at a proper position on a transfer section irrespective of the paper size.

It is still another object of the present invention to provide a paper feeding device which is capable of detecting a paper size and transmitting the detected paper size to an image recording apparatus.

The above and other objects and features of the present invention will become apparent from the following detailed description taken in conjunction with the accompanying drawings.

DETAILED DESCRIPTION OF THE PREFERRED EMBODIMENTS

Figure 1:
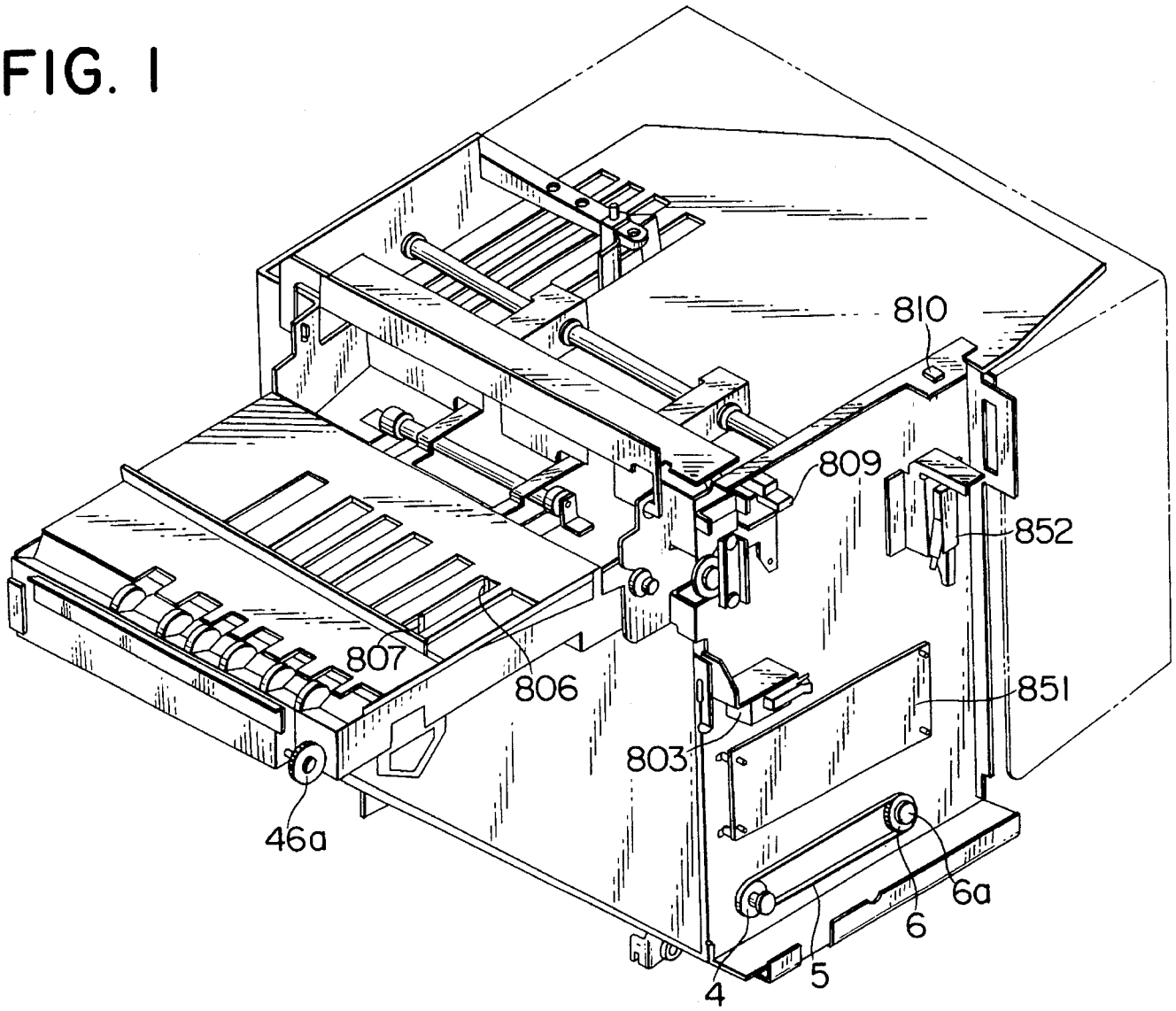
FIG. 1 shows the outer appearance of a paper feeding device according to an embodiment of the present invention.
Figure 2:
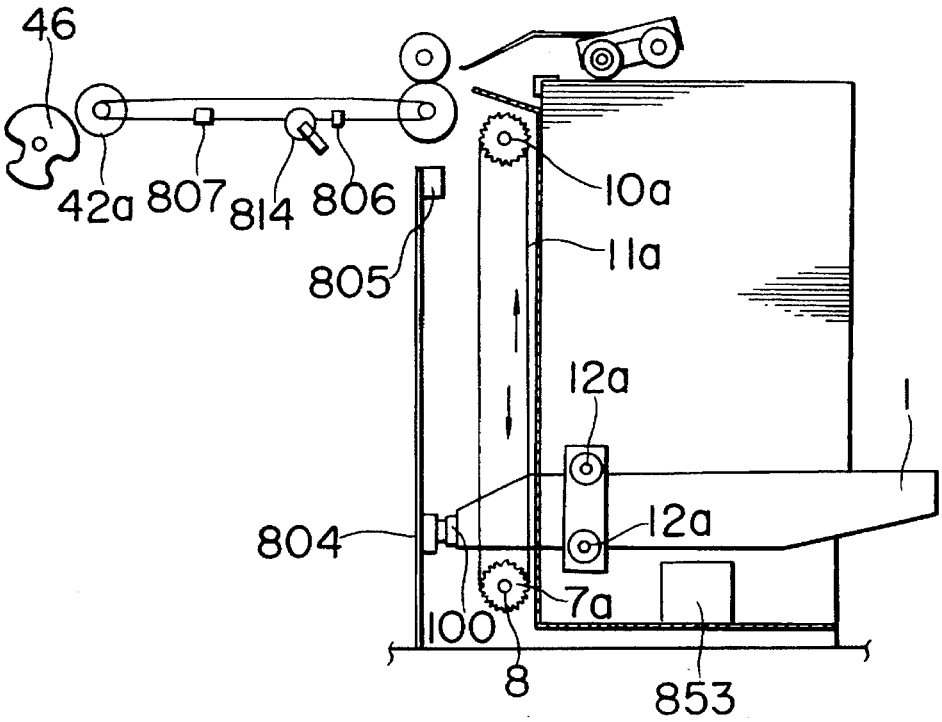
FIG. 2 is a sectional view showing the main part of a mechanism thereof.
Figure 5:
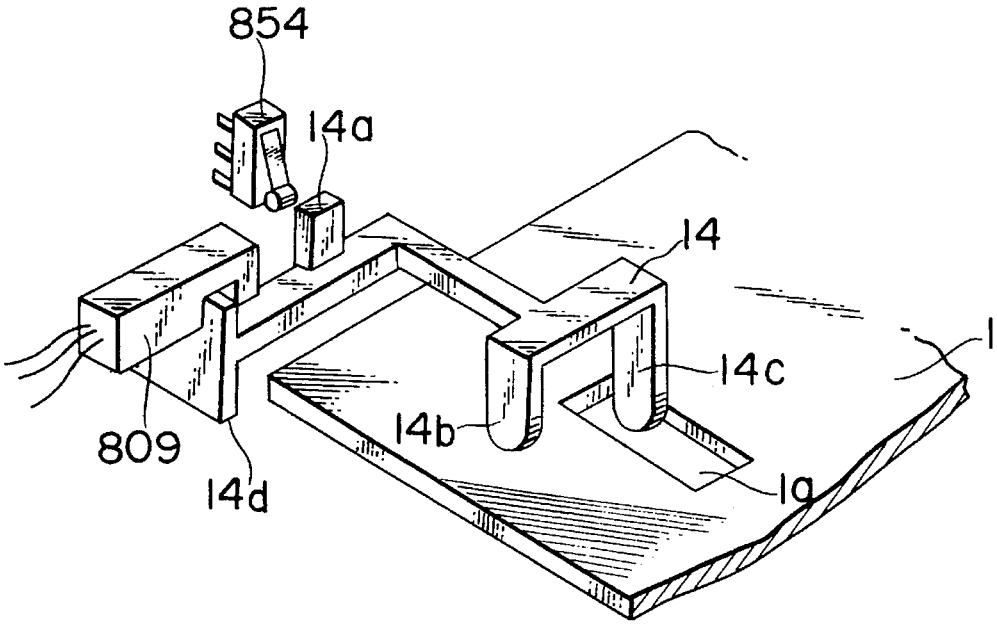
FIG. 5 shows the structure of an overrun detecting section.
Figure 6:
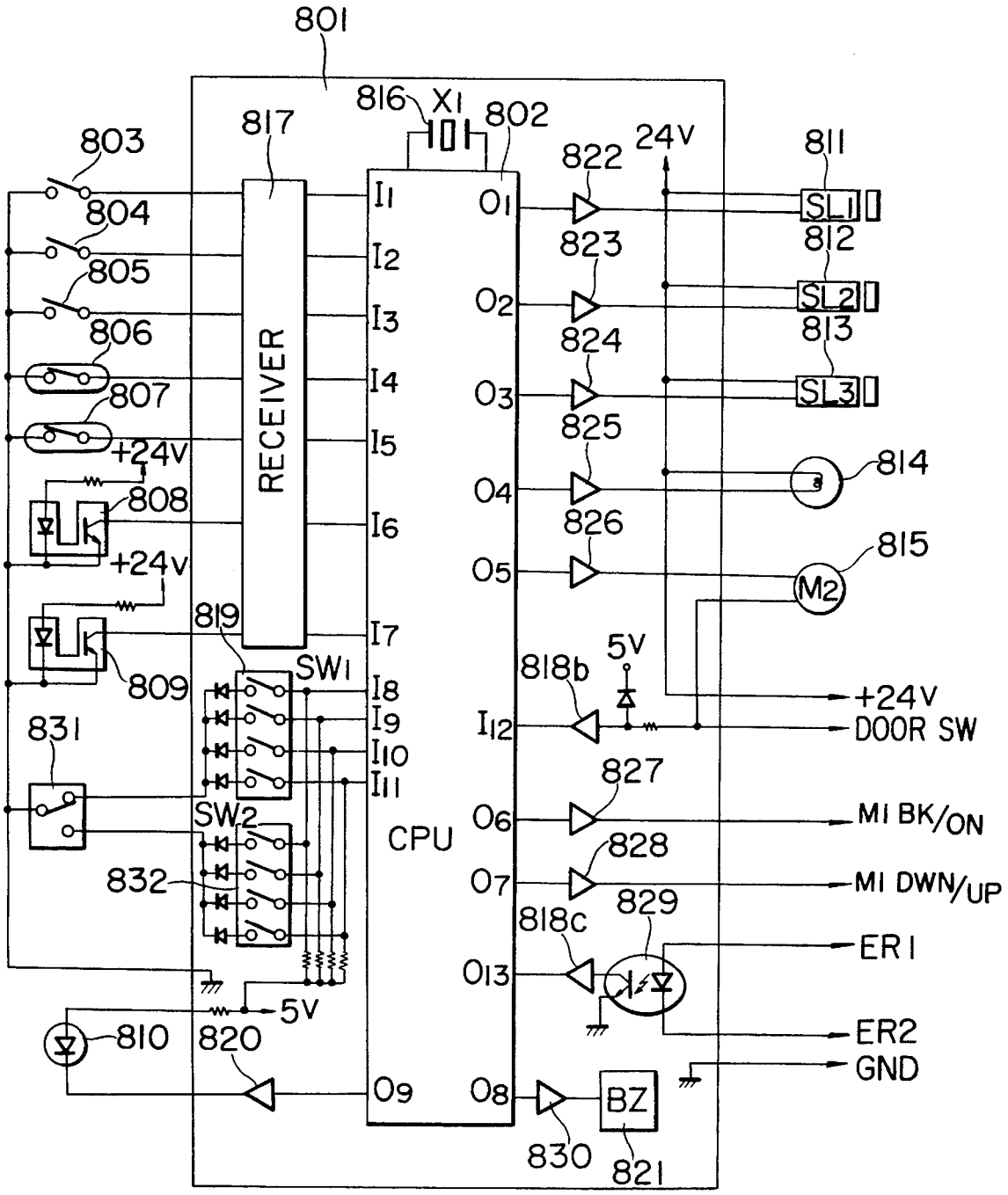
FIG. 6 is a circuit diagram of a main control section.
Figure 7:
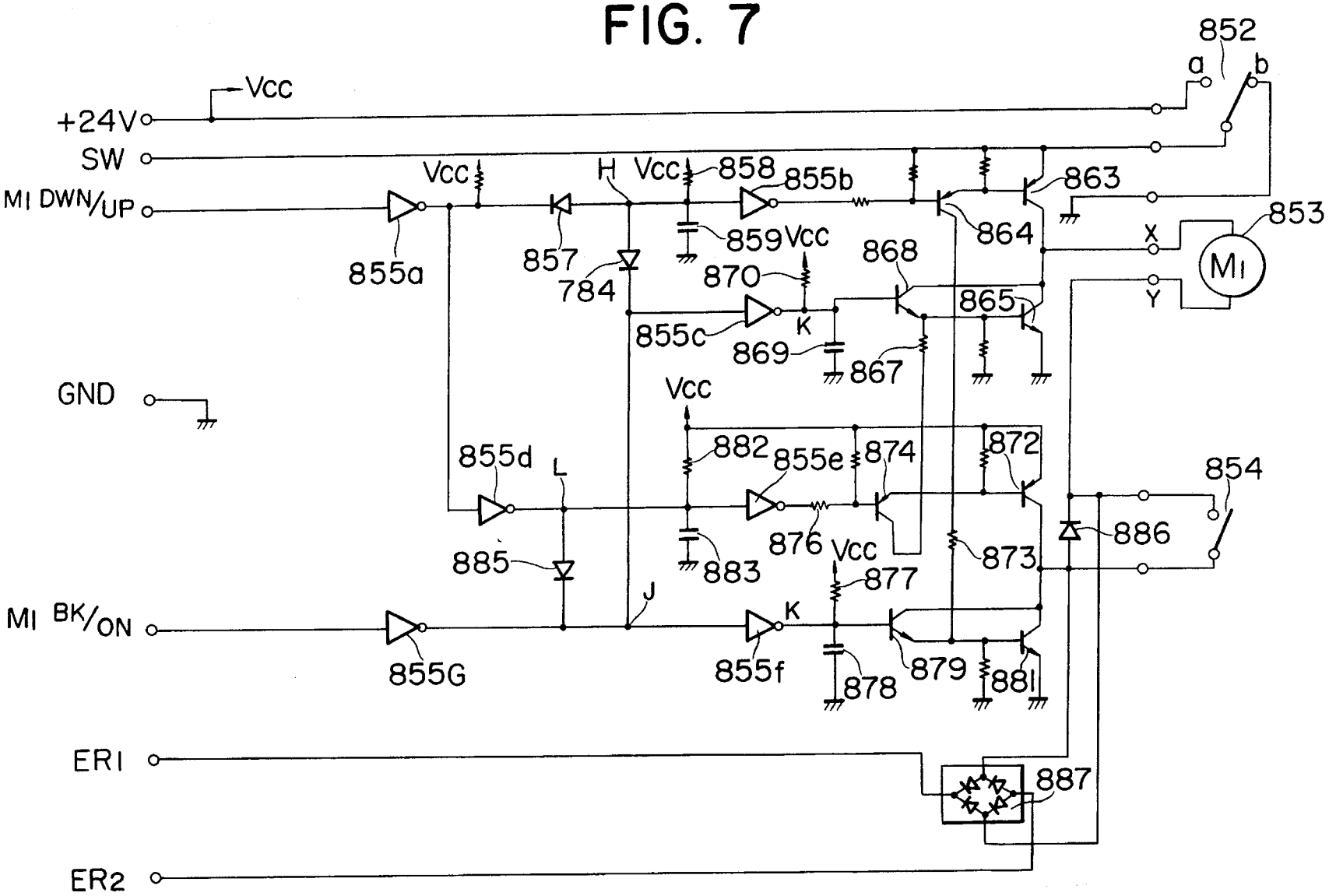
FIG. 7 is a circuit diagram of a lifter motor control section.
Figure 8:
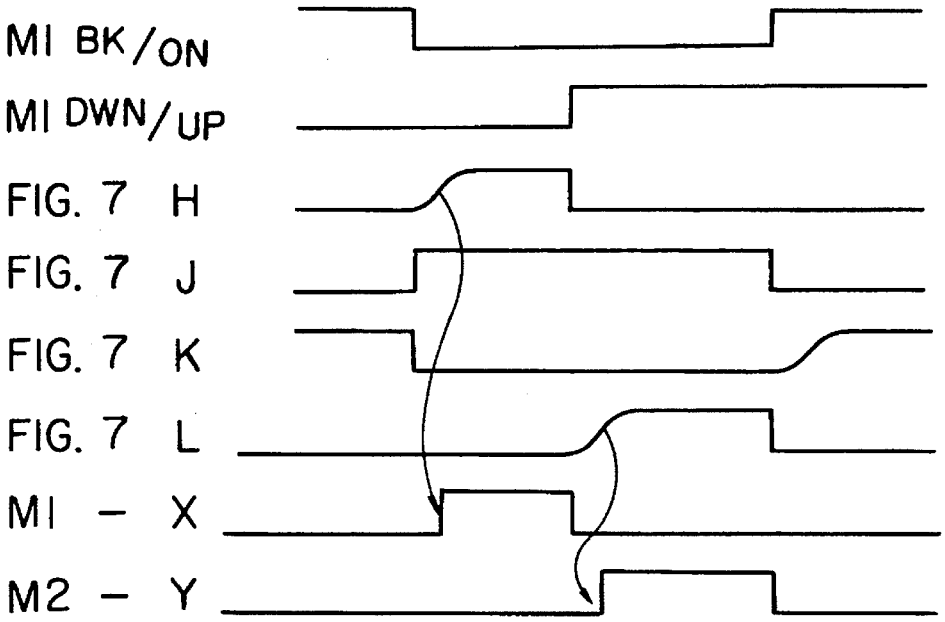
FIG. 8 is a timing chart for controlling the lifter motor.
Figure 9A:
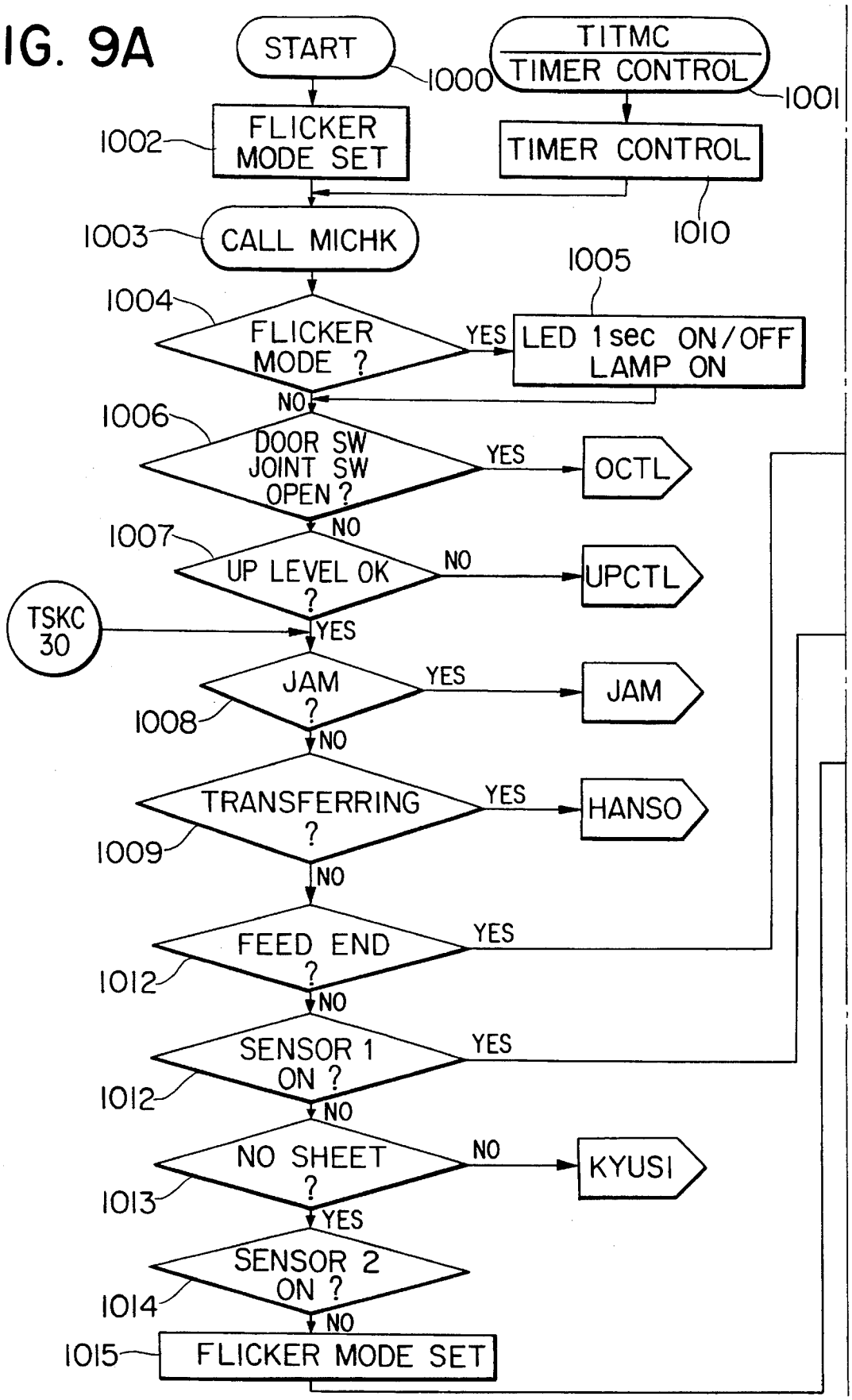
FIG. 9, composed of FIGS. 9A to 9C, FIG. 10 composed of FIGS. 10A and 10B, and FIG. 11, composed of FIGS. 11A and 11B, are flow charts of the main control section.
Figure 9B:
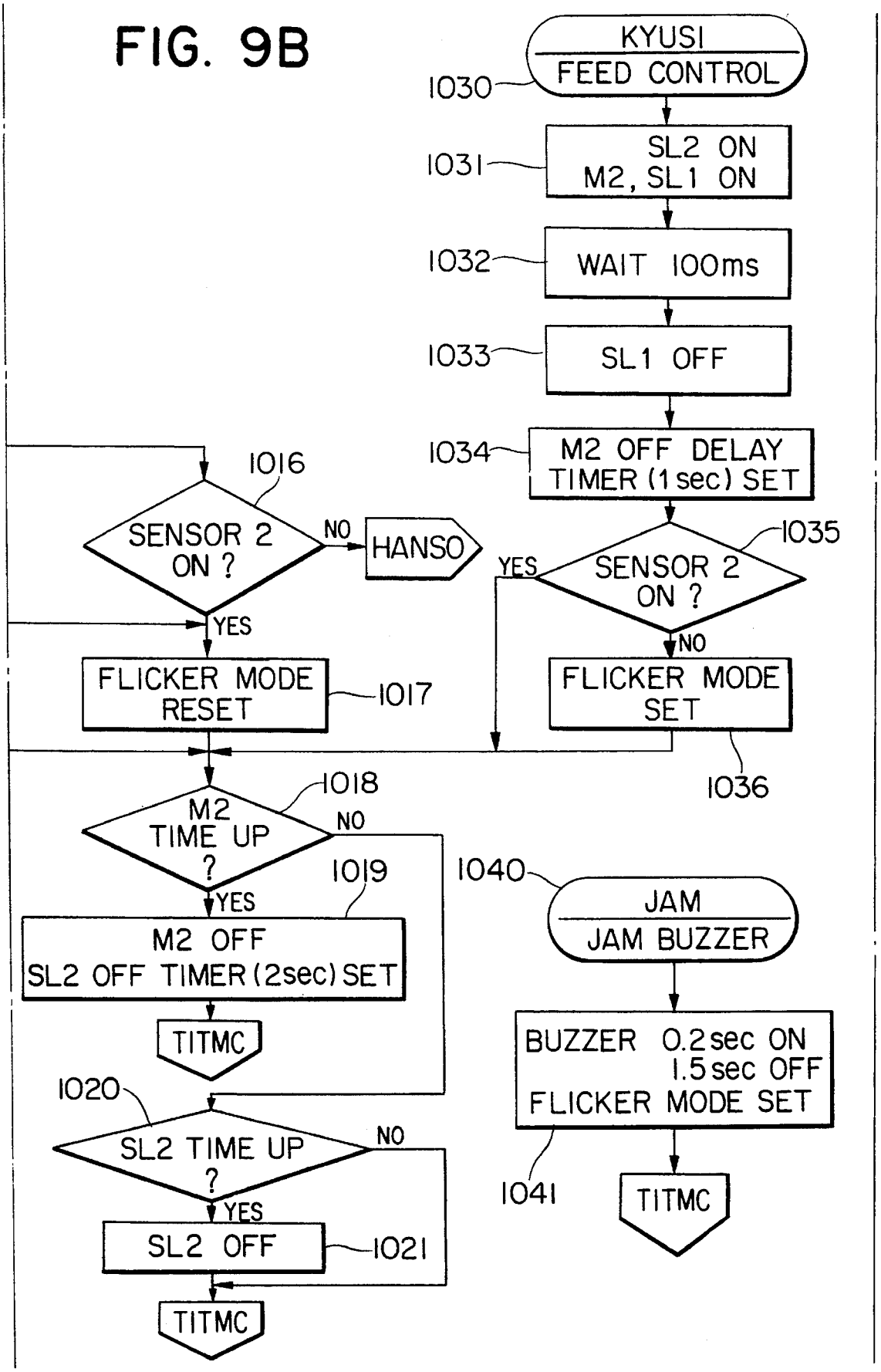
Figures 9, 9C:
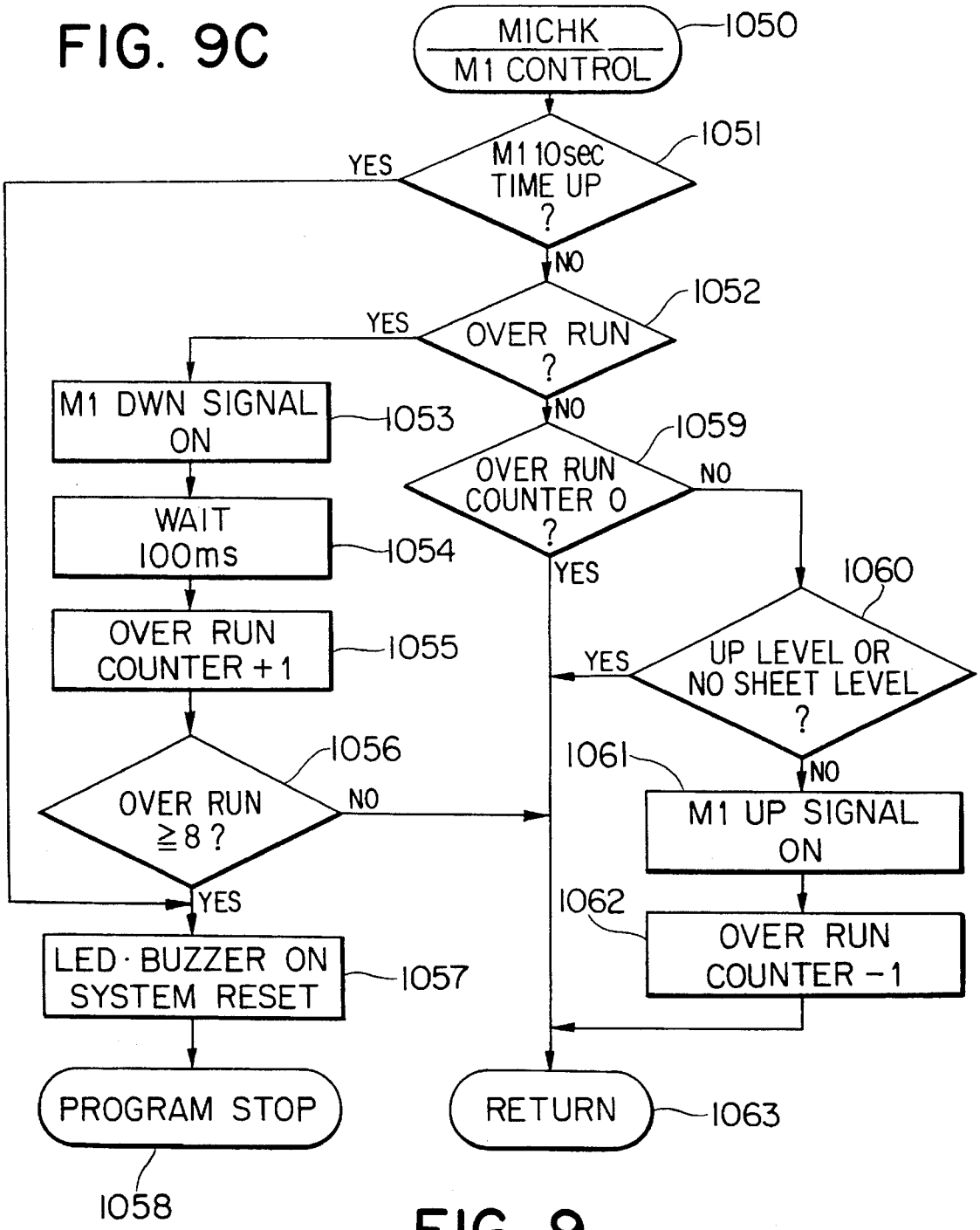
Figures 10, 10A, 10B:
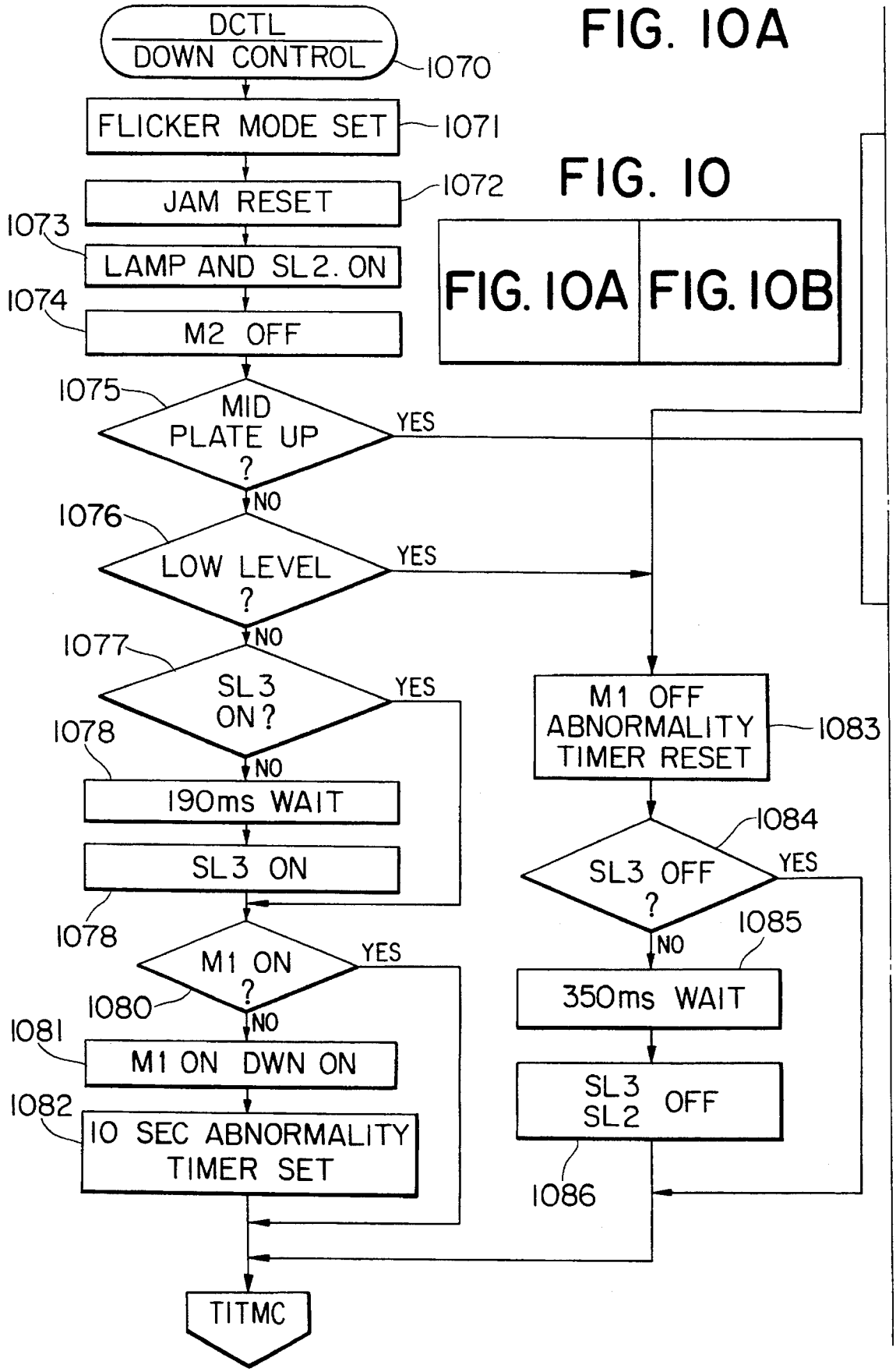
Figure 10B:
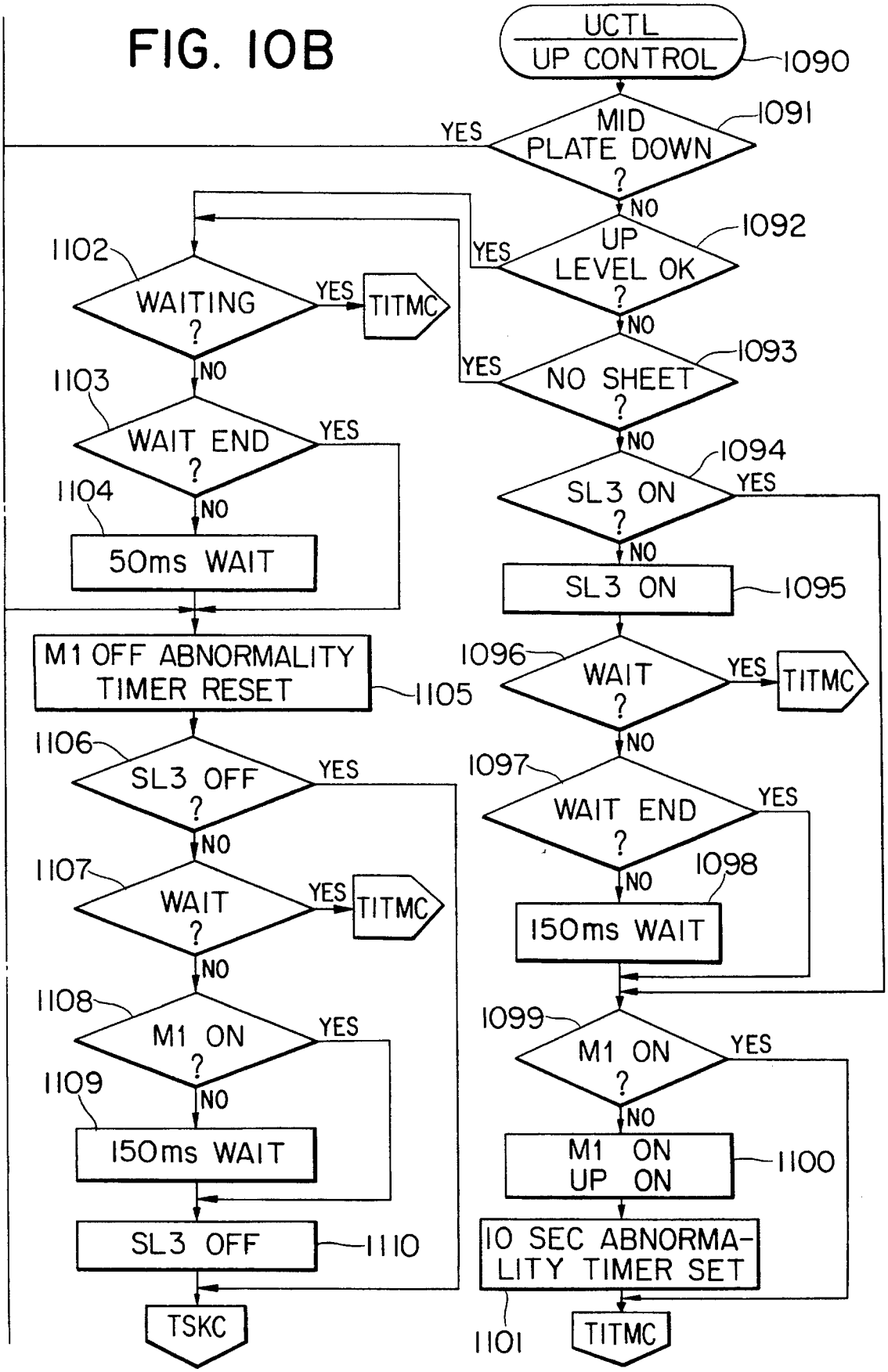
Figure 11A:
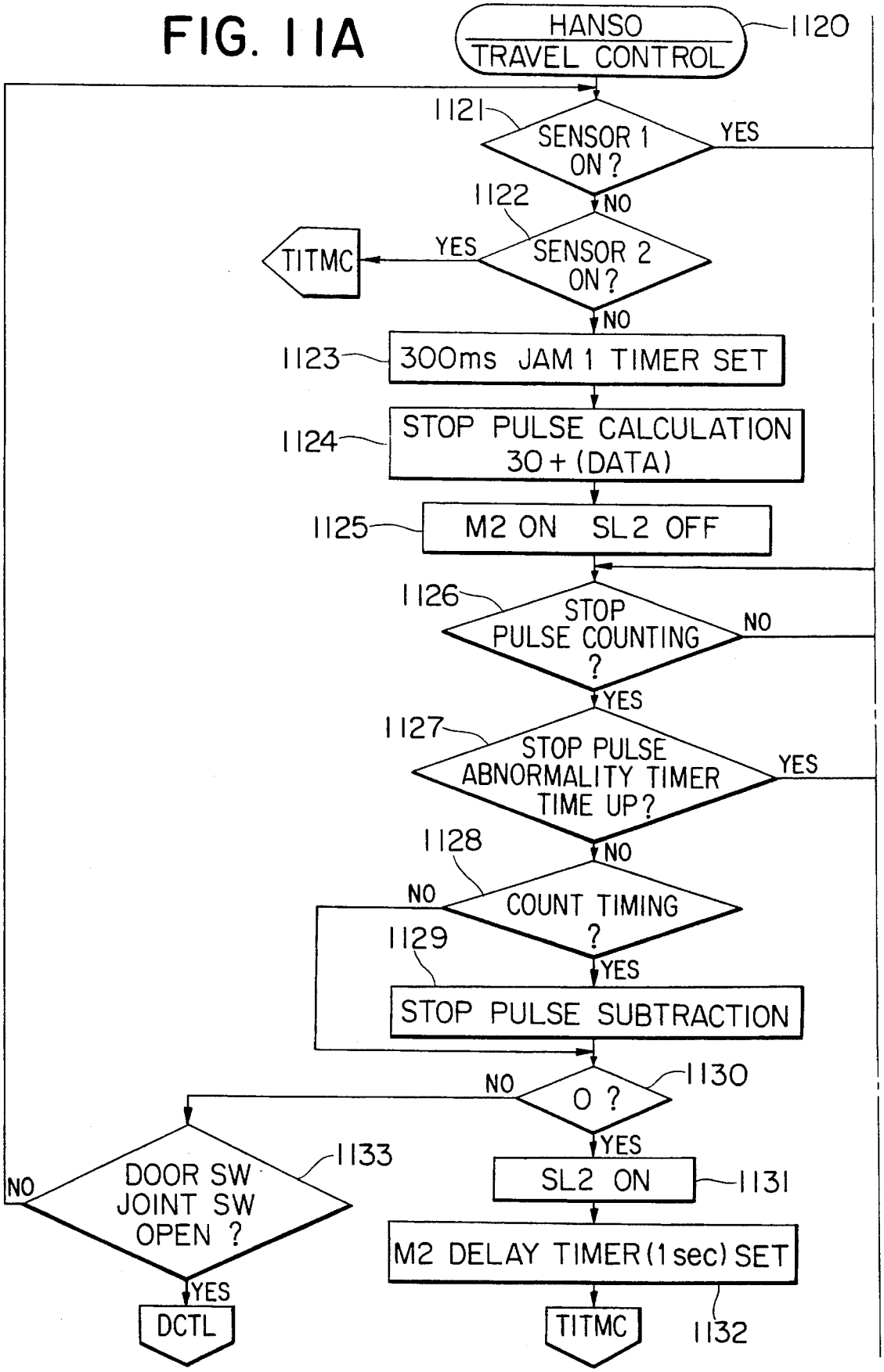
Figures 11, 11B:
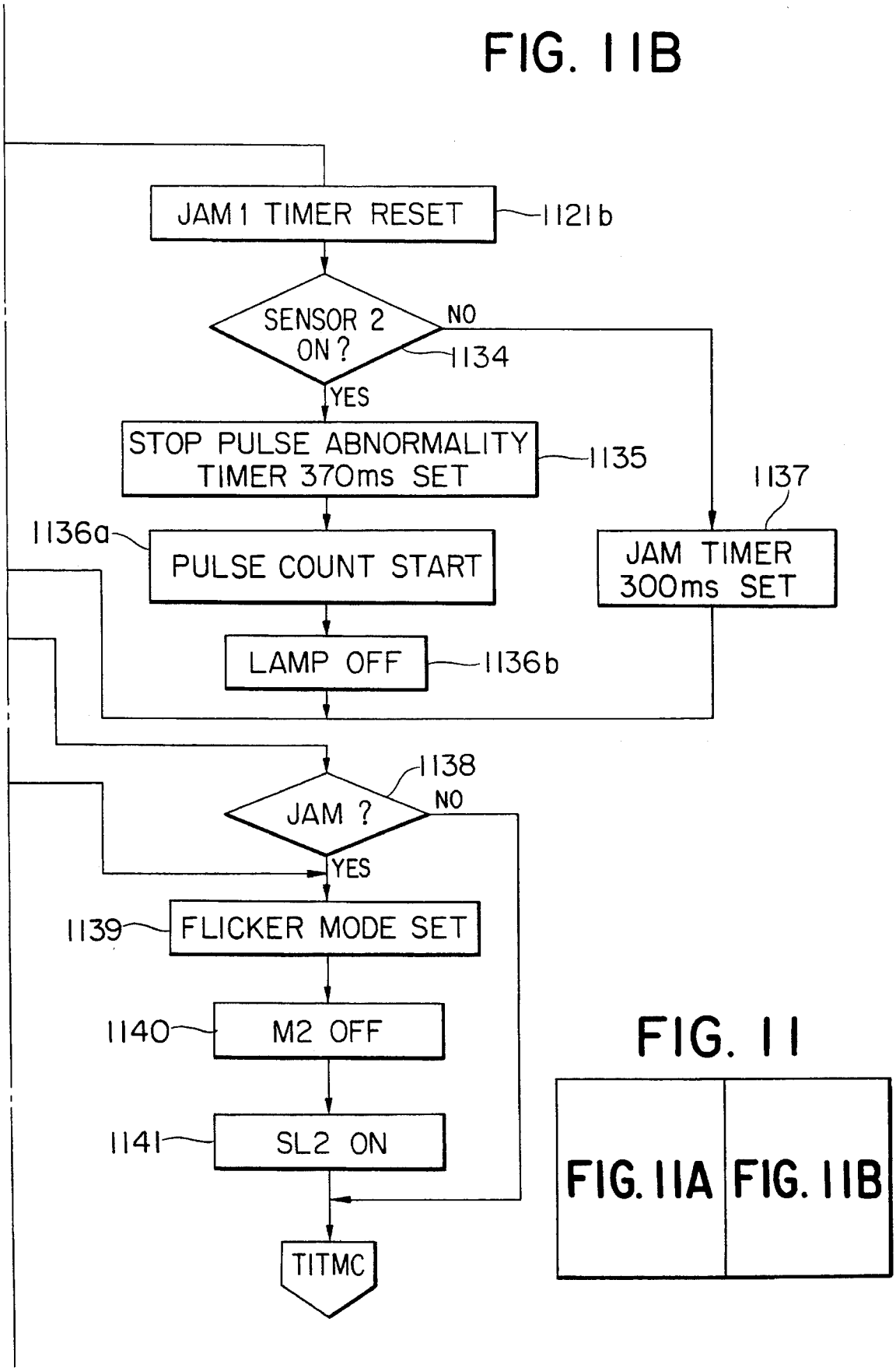

A paper feeding device for feeding paper sheets to an image recording apparatus such as a copying machine according to an embodiment of the present invention will be described. FIGS. 1 to 4 show the outer appearance and construction of the device of this embodiment, and FIG. 5 shows a partial enlarged view thereof. FIG. 6 shows the details of a main control section, FIG. 7 shows the details of a lifter motor M1 control section, and FIG. 8 shows a timing chart thereof. FIGS. 9 to 11 show the control flow charts of the control CPU of this embodiment.

This embodiment will now be described with reference to these drawings.

The paper feeding device of this embodiment mainly consists of a large-volume paper lifter section (to be referred to simply as a lifter section hereinafter) for storing 2,000 cut sheets, for example, and a transfer section for individually picking up the paper sheets from the lifter and holding the transferred paper sheet.

The lifter section has a lifter-type paper storage mechanism (to be referred to as a lifter mechanism hereinafter), a feed mechanism for individually feeding (or moving) paper sheets, and a control section.

In the lifter mechanism, channel rails 13*a* and 13*b* have substantially U-shaped cross sections and are vertically oriented to oppose a side cover. A mid plate 1 serves as a paper lifter and has at each side thereof a pair of vertically arranged rollers 12*a* and 12*b*, respectively. The rollers 12*a* and 12*b* are rotatably mounted and are fitted inside the grooves of the vertical channel rails 13*a* and 13*b* inside the side cover. Accordingly, the mid plate 1 can move vertically along the rails 13*a* and 13*b*. A lifter motor M1 (853) is mounted and held at a lower portion of the lifter section. A sprocket 4 is fixed to the drive shaft of the lifter motor M1 (853). The lifter mid plate 1 is coupled to vertical chains 11*a* and 11*b*. The chains 11*a* and 11*b* are looped around sprockets 7*a*, 10*a* and 10*b* (a fourth such sprocket is present but is not shown) fixed at the two ends of each of rotating shafts 8 and 9 pivotally mounted on the side cover. The lower rotating shaft 8 extends outside the side cover and has a sprocket 6 mounted at its projecting shaft portion through a one-way clutch 6*a*. A chain 5 is looped between the sprockets 6 and 4. The rotational force of the lifter motor M1 (853) is transmitted to the lower rotating shaft 8 through the sprocket 4, the chain 5, the sprocket 6 and the one-way clutch 6*a*. Then, the chains 11*a* and 11*b* vertically move the mid plate 1 through the sprockets, only one of which (7*a*) is shown, fixed to the rotating shaft 8.

Figure 3:
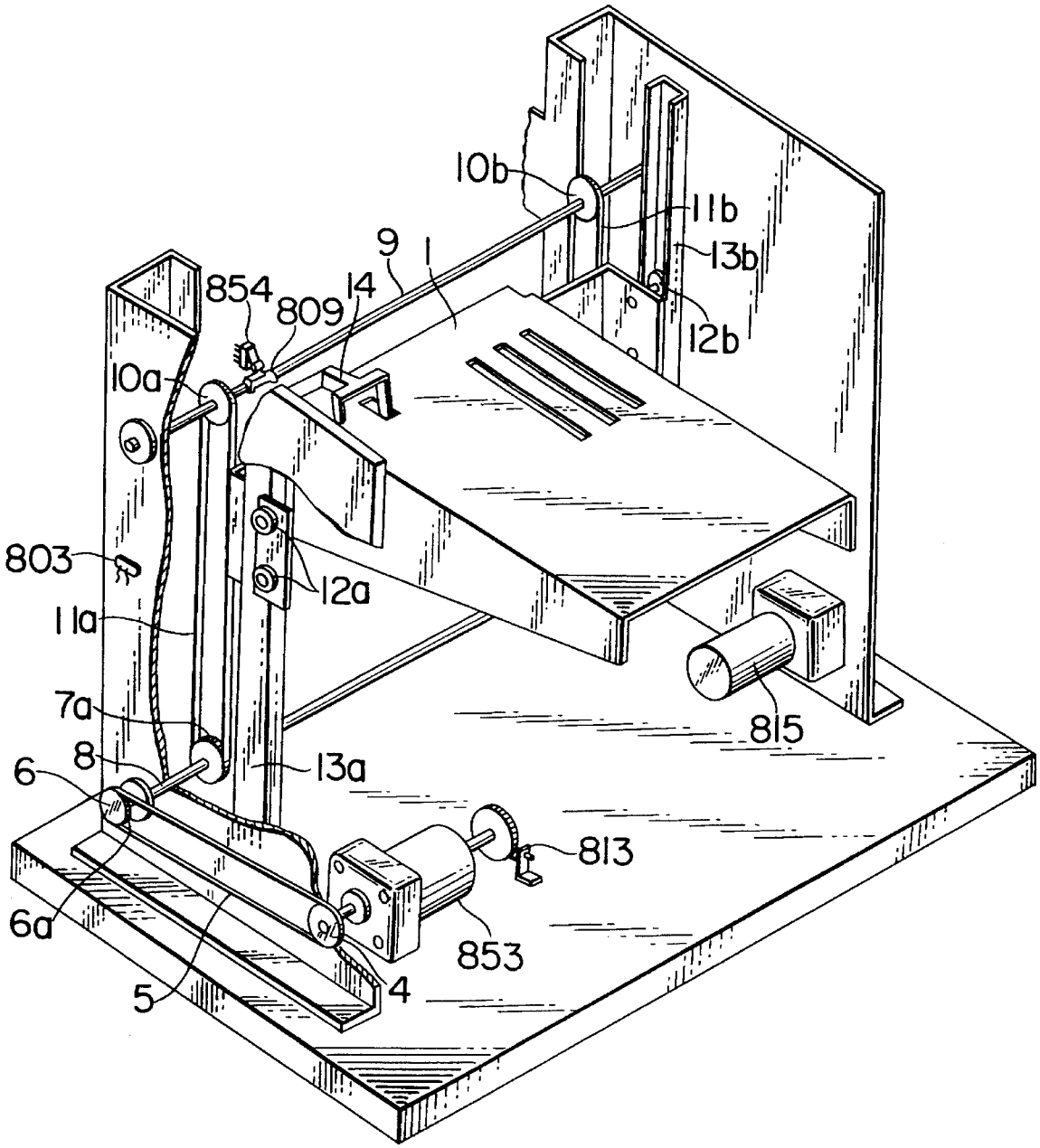
FIG. 3 is a view showing a lifter mechanism thereof.
Figure 4:
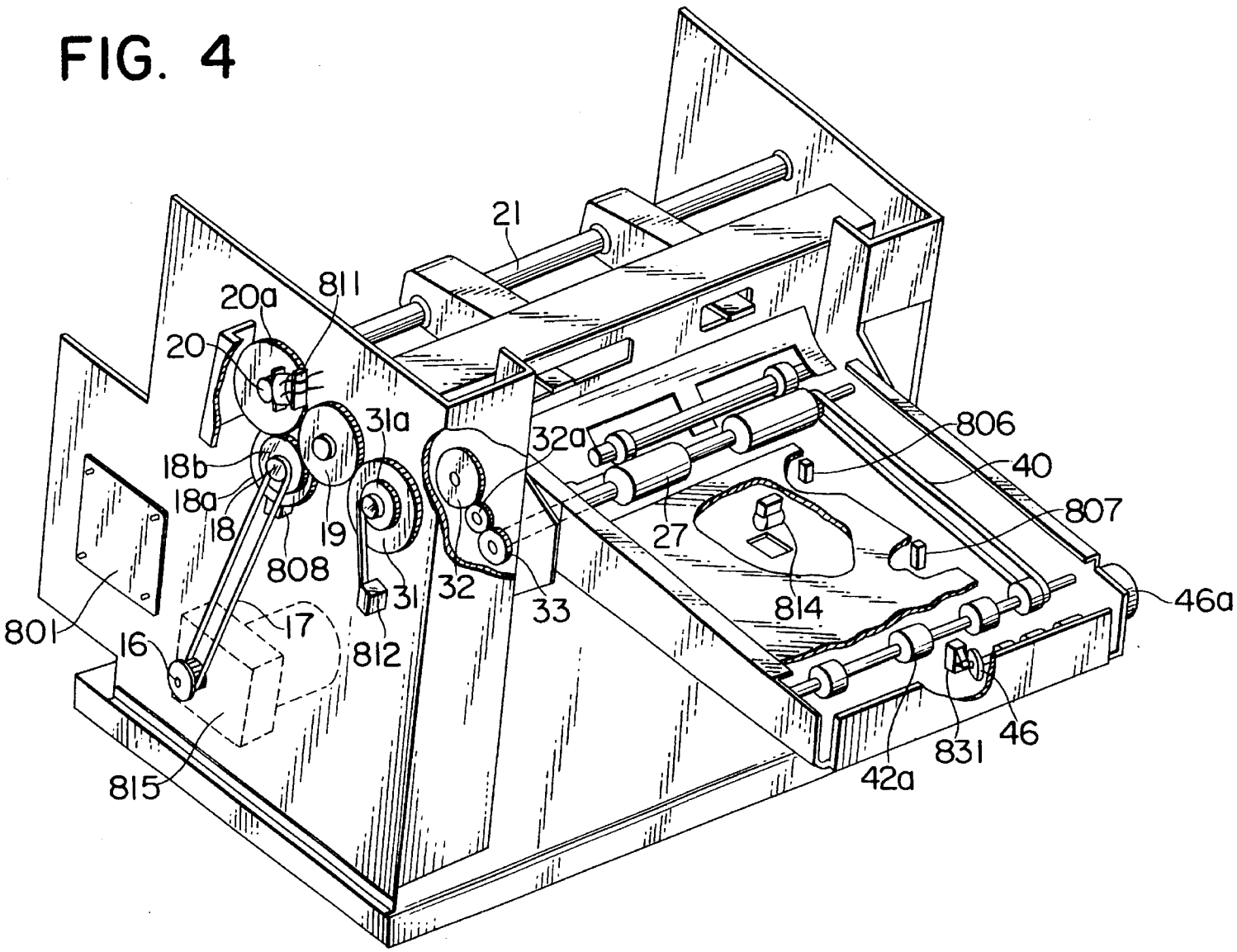
FIG. 4 is a view showing a transfer mechanism thereof.

Referring to FIG. 3, a holding solenoid 813 has a pawl plate which is biased in a direction to mesh with a stopper ratchet wheel which is, in turn, fixed to the rotating shaft of the lifter motor M1 (853). The pawl plate is separated from the ratchet wheel by the attracting force of the solenoid so as to allow rotation of the motor rotating shaft. When the holding solenoid 813 is in the nonattracting mode, the pawl plate engages with the ratchet wheel so as to prevent idling of the rotating shaft of the lifter motor M1 (853). With this feature, idling of the lifter motor M1 (853) when the mid plate 1 is in an up position due to the weight of the paper stacked thereon, and the resultant downward movement of the mid plate 1, can be prevented. Accordingly, the mid plate 1 can be securely held at the up position.

A paper sensor lever 14 is pivotally mounted on the side plate, as shown in detail in FIG. 5. A downward projection 14*c* of the arm section of the sensor lever 14 is constantly in contact with the upper surface of the stack of paper sheets on the mid plate 1 and detects if the paper sheets are within a predetermined position level range PH to PL. An upward projection 14*a* is formed at the proximal portion of the arm section of the sensor lever 14. A limit switch 854 opposes the projection 14*a*. The limit switch 854 detects if the upward movement of the mid plate 1 has taken it outside the predetermined range. An optical path shielding projection 14*d* for an UP level sensor 809 for detecting the uppermost position of the upper surface of the stack of the paper sheets or the position of the uppermost paper sheet is formed near the bearing holding portion of the sensor lever 14. The sensor 809 detects if the upper surface of the stack of paper sheets has reached a lowermost position PL of a range PH to PL.

As the paper sheets stacked on the mid plate 1 are sequentially picked up by the operation of the feed mechanism, the upper surface of the stack of paper sheets is gradually lowered. Then, the sensor lever 14 is gradually inclined and pivoted. When the upper surface of the stack of paper sheets reaches the lowermost position PL, the optical path of the UP level sensor 809 is opened, sensor 809 thereby detecting that the upper surface of the stack of paper sheets has reached the lowermost position PL. In response to a signal from the sensor 809 signalling this state, the holding solenoid 813 is driven through a control circuit for a predetermined period of time so as to raise the mid plate 1 by temporarily driving the lifter motor M1 (853). Thus, the upper surface of the stack of paper sheets is returned to the uppermost position PH. As the paper sheets are used, the mid plate 1 is thus intermittently raised. When the last paper sheet on the mid plate 1 is picked up, the projection 14*c* of the sensor lever 14 drops into a through hole 1*a* formed in that portion of the mid plate 1 which corresponds to the projection 14*c*. Then, the tip of another downward projection 14*b* of the sensor lever 14 is brought into contact with the mid plate 1, thereby opening the optical path of the UP level sensor 809. Before this point in time, a no paper switch 805 is activated by a cam 100 of the mid plate 1. The no paper switch 805 is at a level lower than the height of the mid plate 1 when only one paper sheet is left thereon. The switch 805 operates when the mid plate 1 is within a range where the last paper sheet thereon shields the optical path of the UP level sensor 809. The no paper state of the mid plate 1 is detected in accordance with a signal from the no paper switch 805 and a signal from the UP level sensor 809.

The transfer section will now be described. The transfer section is driven by a transfer motor M2 (815) mounted at a lower portion of the chassis side plate. A sprocket 16 is fixed on the drive shaft of the transfer motor M2 (815). An integral unit of a timing pulley 18, a gear 18*b* and a clock generator disc 18*a* is rotatably mounted on a pin mounted at an upper portion of the chassis side plate. A timing belt 17 is looped around the sprocket 16 and the timing pulley 18.

A feed drive shaft 21 is pivotally journaled at an upper portion of the chassis side plate. A feed sprocket 20*a* is mounted on the drive shaft through a one-rotation clutch 20. The feed sprocket 20*a* engages with the sprocket 18*b*. The rotational force of the transfer motor M2 (815) is transmitted to the pulley 16, the timing belt 17 and the pulley 18 in the order named, and the integral unit comprising the pulley 18, the gear 18*b* and the clock generator disk 18*a* is rotated in accordance with the feed drive shaft 21. When the outer ring of the one-rotation clutch 20 is locked by a pawl arm pivotally controlled by a feed solenoid 811, the engagement between the clutch 20 and the shaft 21 is released, so that rotation of the sprocket 20*a* is not transmitted to the feed drive shaft 21. When the feed solenoid 811 is in the attracting mode and the outer ring of the one-rotation clutch 20 which has been locked by the pawl arm is released, the clutch 20 engages with the feed drive shaft 21 so as to drive it.

The gear 18*b* meshes with a sprocket 19 mounted on a shaft pivotally mounted on the chassis side surface. The sprocket 19 meshes with a sprocket 31 mounted through a one-way clutch 31*a* on a shaft pivotally journaled on the chassis side cover. The one-way clutch 31*a* is locked by a pawl arm, and pivotal movement thereof is controlled by a transfer solenoid 812. When the transfer solenoid 812 is driven and is in the attracting mode, the sprocket 31 is kept in a non-coupled state with the shaft and idles on the shaft. When the transfer solenoid 812 is in the nonattracting mode, the pawl arm is disengaged from the one-way clutch 31*a*, the shaft and the sprocket are coupled, and the shaft is driven. Another sprocket 32 is also mounted on the shaft. The rotation of the sprocket 32 is transmitted through an idler 32*a* to a sprocket 33 mounted on another shaft on which transfer rollers 27 are also mounted. The transfer rollers 27 are then rotated. The rotational force of the transfer rollers 27 drives transfer rollers 42*a* at the distal end of the transfer section through a timing belt 40.

A paper size support cam 46 is mounted at the distal end of the transfer section. When the paper size support cam 46 mounted so as to be exposed outside the chassis plate is rotated, a paper size detection switch 831 is actuated and the size of the tranferred paper sheets is detected.

FIG. 6 is a circuit diagram of a main control section 801. A control section CPU 802 controls the paper feeding device and comprises mainly a known one-chip microcomputer having a ROM, a RAM and so on. The CPU 802 receives sensor signals from various sensors and produces drive control signals.

An input port $I_1$ of the CPU 802 receives through a receiver 817 a signal from a joint switch 803 (FIG. 1) for detecting coupling between the recording apparatus such as a copying machine and the paper feeding device. Input ports $I_2$ and $I_3$ of the CPU 802 receive through the receiver 817 signals from a LOW level switch 804 (FIG. 2) actuated by the cam 100 and from the no paper switch 805. Input ports $I_4$ and $I_5$ of the CPU 802 receive through the receiver 817 signals from a first paper sensor 806 and a second paper sensor 807. In this embodiment, as will be described later, when no paper is detected by the first paper sensor 806 paper sheets are fed upward by the lifter, are stopped, and wait. When the second paper sensor 807 detects no paper, the paper sheets which are waiting are fed to the transfer section. An input port $I_6$ of the CPU 802 receives through the receiver 817 a signal from a clock sensor 808 (FIG. 4) of the clock generator disc 18*a*. Stop control of each paper sheet at the paper transfer section is performed in accordance with the clock pulses obtained in this manner. An input port $I_7$ of the CPU 802 receives through the receiver 817 a signal from the UP level sensor 809 described above. Input ports $I_8$ to $I_{11}$ receive data from a switch 819 or 832 for setting the count number of clock pulses for stop control. The switches 819 and 832 are selectively switched by a paper size detection switch 831 (FIG. 4) in accordance with the paper size. An input port $I_{12}$ of the CPU 802 receives a signal from 10 a door switch 852 (FIG. 1) through a receiver 818*b*. An input port $I_{13}$ of the CPU 802 receives through a receiver 818*a* a signal from the limit switch 854 (FIGS. 5 and 7) indicating that the lifter has moved too far upward.

Output ports $O_1$ to $O_3$ of the CPU 802 produce signals for driving the feed solenoid 811 (SL1), the transfer solenoid 812 (SL2), and the holding solenoid 813 (SL3) through drivers 822 to 824, respectively. A signal for driving a lamp 814 (FIG. 4) is produced from an output port $O_4$ of the CPU 802 through a driver 825. A signal for driving the transfer motor 815 is produced from an output port $O_5$ of the CPU 802 through a driver 826. A signal M1DWN/UP for down/up control of the lifter and a signal M1BK/ON for driving the brake of the lifter motor 853 are supplied from output ports $O_6$ $O_7$ $O_6$ of the CPU 802 to a lifter motor control section as shown in FIG. 7 through drivers 828 and 827, respectively. A signal for driving a buzzer $B_z$ (821) upon detection of abnormal operation of the lifter and a signal for driving an LED 810 (FIG. 4) are produced from output ports $O_8$ and $O_9$ through drivers 830 and 820, respectively.

The CPU 802 does not exchange data with a CPU of the copying machine or other recording apparatus.

After power is turned on, the CPU 802 performs control in accordance with the flow charts shown in FIGS. 9 to 11. The control flow will now be briefly described.

When either the door switch 852 or the joint switch 803 is open, the flow goes to a down control program DCTL (step 1070 and thereafter) from step 1006. In steps 1007 to 1074, the LED 810 is set in the flicker mode, the JAM state is reset, the lamp 814 is illuminated, and the transfer motor M2 (815) is stopped. At this time, if the lifter motor M1 is moving upward, the flow goes to an up interrupt program (step 1105). When the LOW level switch 804 is not ON, in steps 1078 to 1082, the holding solenoid SL3 (813) is turned on so as to release the locked state of the lifter motor M1 and to lower the lifter. When the program is executed until the LOW level swtich 804 is actuated, the flow goes to a down stop program (step 1083 and thereafter). The motor M1 is stopped, the holding solenoid SL3 is energized, and the lifter is stopped at its lowermost position.

When the door cover is closed and the deck is mounted close to the copying machine main body, the door switch 852 and the joint switch 803 are turned on. Then, the sequence goes from step 1007 to an up control routine in step 1090 until the UP level sensor 809 is actuated.

In the up control program (step 1090), if the deck is moving downward, a down stop program (step 1083) is executed. The holding solenoid SL3 (813) is then turned on until the UP level sensor 809 or the no paper switch 805 is turned on. After the locked state of the lifter motor M1 (853) is released, the lifter motor M1 (853) is driven (steps 1094 to 1101).

When the UP level sensor 809 or the no paper switch 805 is turned on after the lifter is moved upward, the lifter motor M1 is stopped after a predetermined period of time as in step 1102. Then, when the motor stops, the holding solenoid SL3 (813) is turned off and the lifter is locked (steps 1102 to 1110).

When the lifter stops at a position to allow feeding and transfer of paper sheets, control is shifted from step 1007 to 1008. When a JAM (paper jamming or the like) occurs during transfer of the paper sheets, the control flow goes from step 1008 to 1040, a jam buzzer is turned on, and the LED 810 is made to flicker. When no paper sheet is fed or transferred, the control flow goes to step 1012.

When no paper sheet is detected by the sensor 1 (806) and the no paper switch 805 is inactive, the flow goes to a feed control routine (step 1030). The transfer motor M2 (815) and the feed solenoid SL1 (811) are turned on to start paper feed. When the stopper of the one-rotation clutch is separated from the solenoid SL1, the feed solenoid SL1 is turned off. After separation is completed, the flow advances from step 1011 to step 1016. When no paper is detected by the paper sensor 2, (807), the flow goes to a travel control routine (step 1120). When no paper has reached the sensors 1 and 2, a correction stop pulse number for transferring is input from the switch 819 or 832 in accordance with the paper size. The stop pulse number is determined, the transfer solenoid SL2 (812) is turned off, and the paper sheets are transferred (steps 1120 to 1125). When a paper sheet reaches the sensor 2, the pulse number from the clock sensor 808 is subtracted from the corrected stop pulse number. When the remainder becomes 0, the transfer solenoid SL2 (812) is turned on, paper sheet transfer is stopped, and the paper sheet is stopped at a predetermined position. In a lifter motor abnormality check subroutine (step 1050), when the UP level sensor 809, the no paper switch 805 or the LOW level switch 804 is not actuated within a predetermined period of time after the motor M1 begins to move the lifter upward or downward, the flow goes from step 1051 to step 1057. In step 1057, the LED 810 and the buzzer 821 are turned on to signal the occurrence of an abnormality. An output to a load is stopped, and control is terminated.

An overrun abnormality is caused only when the limit switch 854 is turned on during the time 10 wherein the lifter motor M1 is moved upward. At this time, a down signal is supplied to the lifter motor M1 through a buffer 855*a* of a lifter motor control circuit. The lifter motor M1 is driven to move the lifter downward. If an overrun abnormality is repeated a predetermined number of times even after this, the CPU 802 terminates the control operation. When an abnormality which has occurred is subsequently corrected, an UP signal is supplied to the control section of the lifter motor M1 upon the downward movement of the lifter below the UP level or a no paper level, thereby moving the lifter upward.

In this manner, even if the limit switch 854 operates erratically due to flapping of paper sheets or the like, reliable feeding and transferring of paper sheets may be performed.

The mode of operation of this embodiment will be described in more detail with reference to the control flow charts (FIGS. 9 to 11) of the program stored in the ROM of the CPU 802.

When power is supplied to the paper feeding device, the flicker mode is set in step 1002. In step 1003, the check/control routine of the lifter motor M1 (853) to be described later is performed. In steps 1004 and 1005, the LED 801 is made to flicker at intervals of 1 second, the lamp 814 is turned on, and the recording apparatus is set in a no paper state. In step 1006, the states of the door switch 852 and the joint switch 803 are checked. When the door switch 852 or the joint switch 803 is opened, a lifter down control program DCTL (step 1070 and thereafter) to be described later is executed. This case corresponds to a case wherein the paper cover is open to set paper sheets inside, or a case wherein the paper feeding device is not coupled to the copying machine main body.

After paper sheets are set on the mid plate 1, the cover is closed. When the cover is closed, the door switch 852 is switched from a contact b to a contact a. A power source voltage +24 V is supplied to the lifter motor M1 up drive circuit. Then, the upward driving of the lifter motor M1 (853) and driving of the transfer motor M2 (815) are enabled. At the same time, a door switch signal is supplied to the CPU 802 through the receiver 818*b*. When the paper feeding device is coupled to the copying machine main body, the joint switch 803 is actuated. Thus, a joint switch signal is supplied to the CPU 802 through the receiver 817. Upon reception of the joint switch signal, the control CPU 802 turns on the lifter motor M1 (853) to move the mid plate 1 upward in accordance with the up control program UCTL (step 1090 and thereafter) until the UP level sensor 809 is actuated. When the mid plate 1 is in a down movement state (step 1091-Y) in the up control program UCTL, the downward movement of the mid plate 1 is terminated by a down stop program (step 1083 and thereafter). If the mid plate 1 is not in the down movement state (step 1091-N), the CPU 802 controls to move the mid plate 1 until the UP level sensor 809 or the no paper switch 805 are actuated. In order to move the mid plate 1 upward, the holding solenoid SL3 (813) is driven in step 1095 to release the locked state of the lifter motor M1 (853). Subsequently, after a predetermined time (e.g., 150 ms.) has elapsed (step 1098), the lifter motor M1 (853) is driven to set the up mode (step 1100). Then, a 10-second abnormality timer to be described later is set (step 1101).

Note that the lifter motor M1 (853) is driven by a M1BK/ON signal and a M1DWN/UP signal from the CPU 802 through the drivers 827 and 828, respectively. This will be described in further detail with reference to FIG. 7.

When a signal M1ON (low level) of the M1BK/ON signal is supplied to a lifter motor M1 control section 851, the output from a receiver 855G goes to high level, output brake ICs 855*c* and 855*f* go to low level, brake drive transistors 868 and 879 are turned off, and the brake of the motor M1 is released. When the signal M1DWN/UP is UP (low level), an output from a down drive IC 855*e* goes high. An output from an up drive IC 855*b* goes low after a predetermined time set by the time constant of a resistor 858 and a capacitor 859. A signal +24 V is applied to the X terminal of the motor M1 through a transistor 863. At the same time, a transistor 881 is turned on through a transistor 864 and a resistor 873. Then, a current flows to the Y terminal of the lifter motor M1 through the limit switch 854 and the transistor 881. The lifter motor M1 (853) is then rotated to move the mid plate 1 upward. The rotational force of the lifter motor M1 (853) moves the mid plate 1 upward in accordance with the sequence as described above. When the uppermost paper sheet on the mid plate 1 presses the sensor level 14 upward, the UP lever sensor 809 is turned on. Then, an output signal from the UP level sensor 809 is supplied to the CPU 802 through the receiver 817. When the UP level sensor 809 is actuated (step 1092-Y), the CPU 802 stops the lifter motor M1 (853) (step 1105) after a predetermined time (50 ms. in this embodiment) (step 1104). After a predetermined time (150 ms.) for stopping the motor (step 1109), the holding solenoid 813 is turned off (step 1110), and the lifter is locked. The upward movement of the mid plate 1 is also stopped when the no paper switch 805 is actuated.

The mode of operation of the lifter motor M1 control section 851 will now be described with reference to FIG. 7 for a case wherein a lifter motor M1 (853) stop signal, that is, a signal M1BK, is produced. The M1 BK/ON signal supplied from the main control section 801 to the section 851 goes to a motor brake level (high level). Inputs to the motor drive ICs 855*b* and 855*e* at the output side of the receiver 855G discharge charges on the capacitors 859 and 883 of the time constant circuit through diodes 884 and 885 to go low level. For this reason, transistors 863, 864, 872 and 874 are turned off, and a power source voltage +24 V is applied to the lifter motor M1 (853). Outputs from the brake drive ICs 855*c* and 855*f* go to high level. Transistors 868, 865, 879 and 881 are driven after delay times determined by time constants of a resistor 870 and a capacitor 869, and a resistor 877 and a capacitor 878. Thus, the X and Y terminals of the lifter motor M1 (853) are short-circuited. In order to consume an electromotive force generated during the rotation of the lifter motor M1 (853), a strong braking force may be applied.

Thus, the lifter stops at a position where a paper sheet may be picked up and transferred. In a case wherein no paper sheet is detected by the first paper sensor 1 (806) and the no paper switch 805 is not 0N (steps 1012 and 1013), the CPU 802 executes a feed control routine KYUSI (step 1030 and thereafter) to feed paper sheets.

The transfer motor M2 (815) is driven through the driver 826, and the feed solenoid SL1 (811) is driven through the driver 822 (step 1031). When the feed solenoid SL1 (811) is driven, the one-rotation clutch 20 is actuated to rotate the feed drive shaft 21. During this time, the transfer solenoid SL2 (812) is actuated. The feed solenoid SL1 (811) is turned off (step 1033) after a predetermined time (100 ms. in this embodiment) which is sufficient to allow separation of the stopper of the one-rotation clutch 20 has elapsed (step 1032). Thus, the feed drive shaft rotates only once, and sets one paper sheet on the transfer rollers 27 through the pickup roller.

A transfer motor M2OFF delay timer (of 1 second) is set (step 1034). It is checked in step 1035 if the paper sensor 2 detects a paper sheet. If NO in step 1035, the flicker mode is set to cause the LED 810 to flicker (step 1036). This timer serves to turn off the transfer motor M2 for energy conservation when no waiting paper sheet is supplied to the copying machine main body within a feed time for continuous copying. When the timer time is up, the transfer motor M2 is turned off, and the SL2 off timer (of 2 seconds in this embodiment) is set. When this timer time is up, the transfer solenoid is turned off, and the device waits in the feed/transfer stop mode (steps 1018 to 1021). If no paper sheet is detected by the paper sensor 2 (807) when the paper sheet is set on the transfer rollers 27 (step 1011-Y), a travel control routine HANSO (step 1120 and thereafter) is executed. In the travel control routine HANSO, when no paper is detected by the sensor 1 (806) and the sensor 2 (807), the JAM timer (of 300 ms. in this embodiment) of the transfer system is set (step 1123). Then, stop pulse calculation data (I8 to I11) set by the switch 819 or 832 selected by the paper size detection switch 831 is fetched in the CPU 802. The CPU 802 calculates a stop clock number for stopping the paper sheet (step 1124). Then, the transfer motor M2 (815) is driven, and the transfer solenoid SL2 (812) is set in the nonattracting mode. The rotational force of the transfer motor M2 (815) is transferred to the transfer rollers 27 and 42*a* through the one-way clutch 31*a* to start transferring the paper sheet (step 1125). When the paper sheet is transferred to the paper sensor 1, the JAM timer described above is reset and a jam time (of 300 ms. in this embodiment) from the sensor 1 to the sensor 2 is set (step 1137). When the paper sheet is transferred from the sensor 1 to the sensor 2, the JAM timer is released, and another JAM timer (of 370 ms. in this embodiment) is set (step 1135). The slit of the clock generator disc 18*a* mounted on the pulley 18 is detected by the clock sensor 808. The clock sensor 808 produces a clock pulse. The clock pulse count is started (step 1136*a*) and the lamp 814 is turned off (step 1136*b*). When the clock pulses are counted (steps 1126 to 1129) and a count number reaches the stop clock number (step 1130), the transfer solenoid SL2 (812) is turned on (step 1131), the transfer of the paper sheet is stopped, and the paper sheet is stopped at a predetermined position. The M2OFF delay timer described above is set (step 1132).

At this time, the paper sensor 2 is detecting the paper sheet. Accordingly, the flicker mode is reset (steps 1016 and 1017), and the LED 810 is switched from the flicker mode to the continuous 0N mode.

In the travel control routine, when the number of stop pulses does not reach a predetermined number after the time set by the stop pulse abnormality timer has elapsed, or when the paper sheet does not reach both sensor 1 and sensor 2 within a predetermined period of time from the start of transfer, the transfer/drive system may be defective. Therefore, the flicker mode is set (step 1139), the transfer motor M2 (815) is stopped (step 1140), and the transfer solenoid is attracted (step 1141), thereby stopping the transfer/drive system.

If no paper sheet is transferred to the copying machine main body within a maximum period (1 second in this embodiment) of the paper feed interval in the continuous feed mode, the transfer motor M2 (815) is stopped (steps 1018 and 1019). Thereafter, the transfer solenoid SL2 (812) is turned off (steps 1020 and 1021).

When the transferred paper sheet is moved out from the transfer section and there is no paper sheet at the position of the paper sensor 1, the feed control routine is performed. When no paper is subsequently detected by the paper sensor 2, the travel control routine HANSO described above is repeated.

When several paper sheets have been picked up/transferred, the paper level sensor lever 14 is lowered, and the UP level sensor 809 is no longer 0N (step 1007), the up control program UCTL (step 1090 and thereafter) is performed such that the upper surface of the stack of paper sheets is returned to the uppermost position PH.

In order to prevent damage to the equipment when the mid plate 1 is moved outside the predetermined range by erratic operation or the like of the main control section, the motor control section or the like, an abnormal upward movement is detected by the projection 14*c* when paper sheets are stacked on the mid plate 1 and by the projection 14*b* when there is no paper sheet on the mid plate 1. Then, the limit switch 854 is actuated by the upward projection 14*a* at the proximate portion of the arm section of the sensor lever 14 so as to cut off supply of an up drive voltage to the lifter motor M1 (853). When the limit switch 854 is actuated during the upward movement of the lifter motor M1 (853), the switch 854 is opened, and a potential difference of +24 V appears across the two terminals of the switch. This potential difference is supplied to the CPU 802 as an up abnormal signal through a diode bridge 887 and a photocoupler 829 of the main control section. When the CPU 802 detects an abnormal upward movement (step 1052) before the M1 timer time set in step 1082 or 1101 is up (step 1051), the CPU 802 renders the signal M1DWN/UP to DWN through the driver 828 (step 1053). After a predetermined time (of 100 ms. in this embodiment) has elapsed (step 1054), the content of the overrun counter is incremented by one (step 1055). When an overrun occurs more than a predetermined number of times (more than 8 times in this embodiment) within a predetermined period of time (10 seconds in this embodiment), an alarm/display is performed by an LED, a buzzer or the like, and the paper feeding device is stopped (steps 1057 and 1058). When the mid plate 1 is at the position of the UP level sensor 809 or at the position of the no paper switch 805 after an abnormal upward movement is released by the downward movement of the plate 1, up control is terminated (steps 1060 to 1063). When the mid plate 1 is below the position of the UP level sensor or the no paper switch, the lifter motor M1 (853) is driven to move the plate 1 upward (step 1061). Thus, the up control is restored. At the same time, the count of the abnormalities is reduced, so that an abnormality which occurs subsequently can be released. For this reason, even when the limit switch 854 operates erratically due to flapping of a paper sheet or the like, normal pickup/transfer of the paper sheet is performed.

When the M1 timer (10 seconds) is not reset after the up or down control is started, an alarm is produced from an LED, a buzzer or the like to stop the paper feeding device.

A diode 886 is connected in parallel with the limit switch 854. When the lifter motor M1 (853) is driven to move the plate 1 upward, a power source voltage of +24 V is applied to the cathode of the diode and a GND potential is applied to the anode thereof. Accordingly, when the limit switch 854 is open, a potential difference of +24 V is established across the two ends of the diode 886. This potential difference 886 is detected by the diode bridge 887 so as to detect an excessive upward movement of the lifter. While the lifter motor M1 (853) is moving downward, a GND potential is applied to the cathode of the diode 886, and a power source voltage of +24 V is applied to the anode thereof. Accordingly, only a small potential difference is established across the two ends of the diode. Thus, the output from the diode bridge 887 remains OFF. Even if the limit switch 854 operates erratically and is open, erratic operation of the device may not be caused. When a brake signal is supplied to the lifter motor M1 (853), the anode and cathode of the diode 886 are both at GND potential. Even if the limit switch 854 operates erratically, the output signal from the diode bridge 887 is similarly kept OFF. Thus, an abnormal upward movement of the mid plate 1 will not be erroneously detected.

Control will now be described with reference to a case wherein there is no paper sheet.

When all the paper sheets on the mid plate 1 have been fed, the projection 14*c* falls into the through hole la formed in the mid plate 1. At the same time, an output from the no paper switch 805 is supplied to the CPU 802 through the receiver 817. When no paper is detected by both the first paper sensor 806 and the paper sensor 807 of the transfer section, the CPU 802 turns on the lamp 814 to signal to the copying machine main body that there is no paper sheet. In response to this, the copying machine main body displays or indicates that there is no paper sheet.

When the paper guide is moved upward or the paper feeding device is separated from the copying machine main body, the door switch 852 or the joint switch 803 is operated (step 1006) so as to execute the down control program DCTL (step 1070 and thereafter). When the down control program is started, the CPU 802 first sets the flicker mode (step 1071) so as to cause the lamp 814 to flicker and drives the transfer solenoid SL2 (812) (step 1073) so as to stop the transfer motor M2 (815) (step 1074). Then, if the lifter is being raised, the upward movement is stopped (step 1075-Y to step 1105 and thereafter). When the lifter is at a lowermost position where the low level switch 804 is turned on, the lifter motor M1 (853) is stopped (step 1083). Subsequently, the holding solenoid SL3 (813) and the transfer solenoid SL2 (812) are turned off so as to lock the lifter motor M1 (step 1086) o When the lifter has not reached the position where the LOW level switch 804 is turned on (step 1076-N, the holding solenoid SL3 (813) is driven (step 1079) to release the locked state of the lifter motor M1 (853). Thereafter, the CPU 802 supplies a signal M1ON and a signal M1DWN to the M1 control section through the drivers 827 and 828, respectively (step 1081). The 10-second abnormality timer is set (step 1082). If the downward movement of the lifter is not terminated even after the time up of this timer, the CPU 802 causes the driver 830 to turn on the buzzer 821 and the driver 820 to turn on the LED 810. Thus, the operation is interrupted (step 1057).

When the signal M1ON (low level) is supplied to the M1 control section 851, an output from the receiver 855G is OFF (high level). Then, the brake drive transistors 868 and 879 are turned off through the brake drive ICs 855*c* and 855*f*, thereby releasing the braking force. If the signal M1DWN/UP is set at M1DWN (high level), the output from the receiver 855*a* goes low. The charge on the capacitor 859 is discharged through the diode 857. After the discharge is terminated, the output from the up drive IC 855*b* goes high. Then, the transistor 863 is turned off, and no up voltage is applied to the lifter motor M1 (853). When the output from the IC 855*a* goes low, the output from the IC 855*d* goes high and the capacitor 883 is charged through the resistor 882. The output from the IC 855*e* goes low with a time delay corresponding to the charging time of the capacitor 883. As a result, a base current of the transistor 874 flows, the transistor 872 is turned on, and a power source voltage of 24 V is supplied to the Y terminal of the lifter motor M1 (853) through the limit switch 854 or the diode 886. A collector current of the transistor 874 turns on the transistor 865 through the resistor 867 to hold the X terminal of the lifter motor M1 (853) at GND level. Thereafter, the GND potential is applied to the X terminal of the lifter motor M1 (853), and the voltage of +24 V is applied to the Y terminal thereof. The lifter motor M1 is driven to move the plate 1 downward.

When the lifter moves downward and the cam 100 mounted on the mid plate 1 actuates the low level switch 804 (step 1076-Y), a signal M1ON is changed to a signal M1BK to stop the lifter motor M1 (853) (step 1083). Thereafter, after a predetermined time (350 ms. in this embodiment) for stopping the motor has elapsed (step 1085), the holding solenoid SL3 (813) is turned off to fix the mid plate 1. If the lifter is moved too far downward due to an abnormality of the LOW level switch 804 or the like, the mid plate 1 abuts against the bottom plate. Then, the driving state becomes an idling state by action of the one-way clutch 6*a*of the drive transmission sprocket 6. Accordingly, the equipment is protected from any damage, an abnormality is detected by the 10-second timer, and the motor is stopped.

Figure 12:
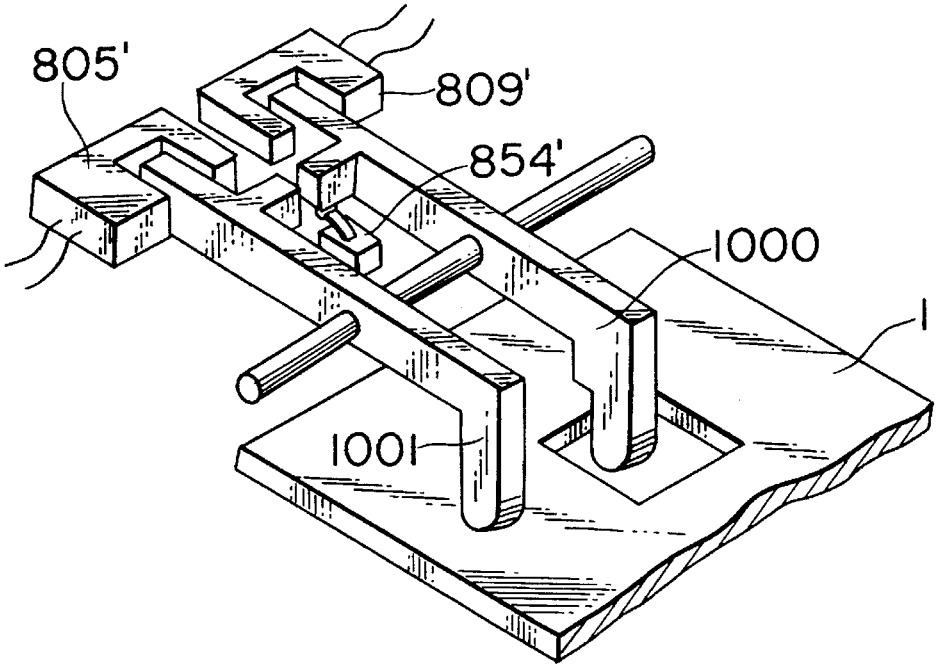
FIG. 12 shows another structure of a sensor lever and a no paper switch.

As shown in FIG. 12, a mid plate sensor lever 1001 and a level sensor 1000 are pivotally mounted on the same shaft. Sensors 805' and 809' detect the positions of the sensor lever 1001 and the sensor 1000. When the sensor 805' produces a signal indicating the presence of the lever 1001 and the sensor 809' produces a signal indicating the absence of the sensor 1000, it is determined that there is no paper sheet on the mid plate 1. Then, the adjustment of the no paper switch 805 and the UP level sensor 809 is terminated.

The above embodiment is described with reference to a case of a paper feeding device for feeding paper sheets to a recording apparatus such as a copying machine. However, the material of the sheet-like medium need not be paper but also be similar materials. Also, the paper sheets may be fed individually or continuously. It is also to be understood that the present invention can be similarly applied to a paper feeding device for an apparatus which requires individual feeding of paper sheets other than the recording apparatus.

Figure 13:
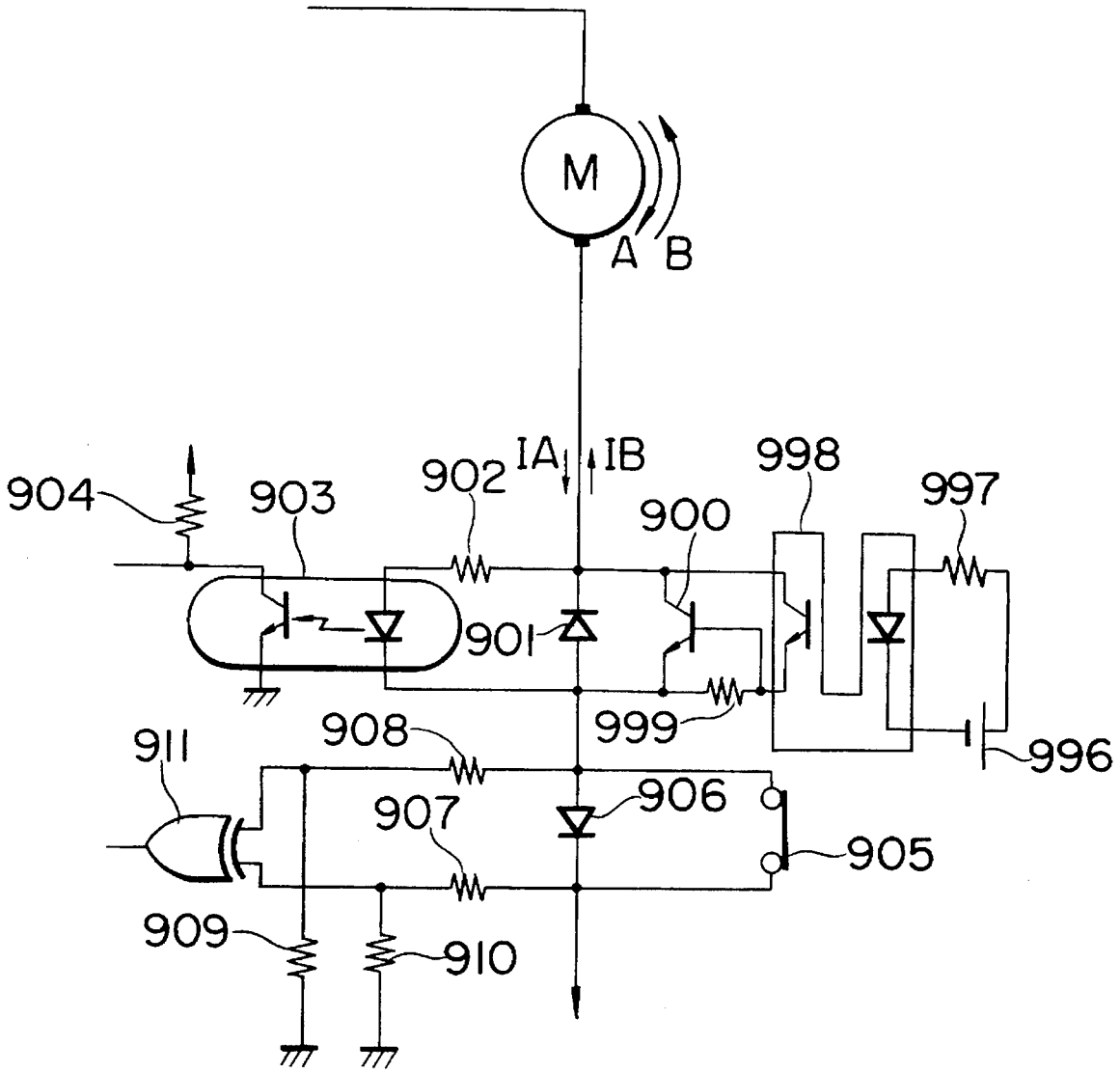
FIG. 13 is a view showing a modification of an overrun detecting section.

A modification of the overrun detecting means will now be described with reference to FIG. 13.

In this modification, the switching element comprises a photointerruptor 998 and a transistor 900 and therefore does not use any contact.

A circuit for detecting a potential difference comprises a photocoupler 903 and an EX-OR gate 911.

In this modification, two sets of elements each set comprising a rectifying element and a switching element are used. With the modification of this configuration, an abnormality during the forward/reverse rotation of the motor can be detected.

Such an overrun detecting means is not limited to use in a paper feeding device. That is, for example, it may be similarly used in a structure wherein a movable member is driven by a motor, such as a sorter, a drive system for an optical system or the like.

Figure 14:
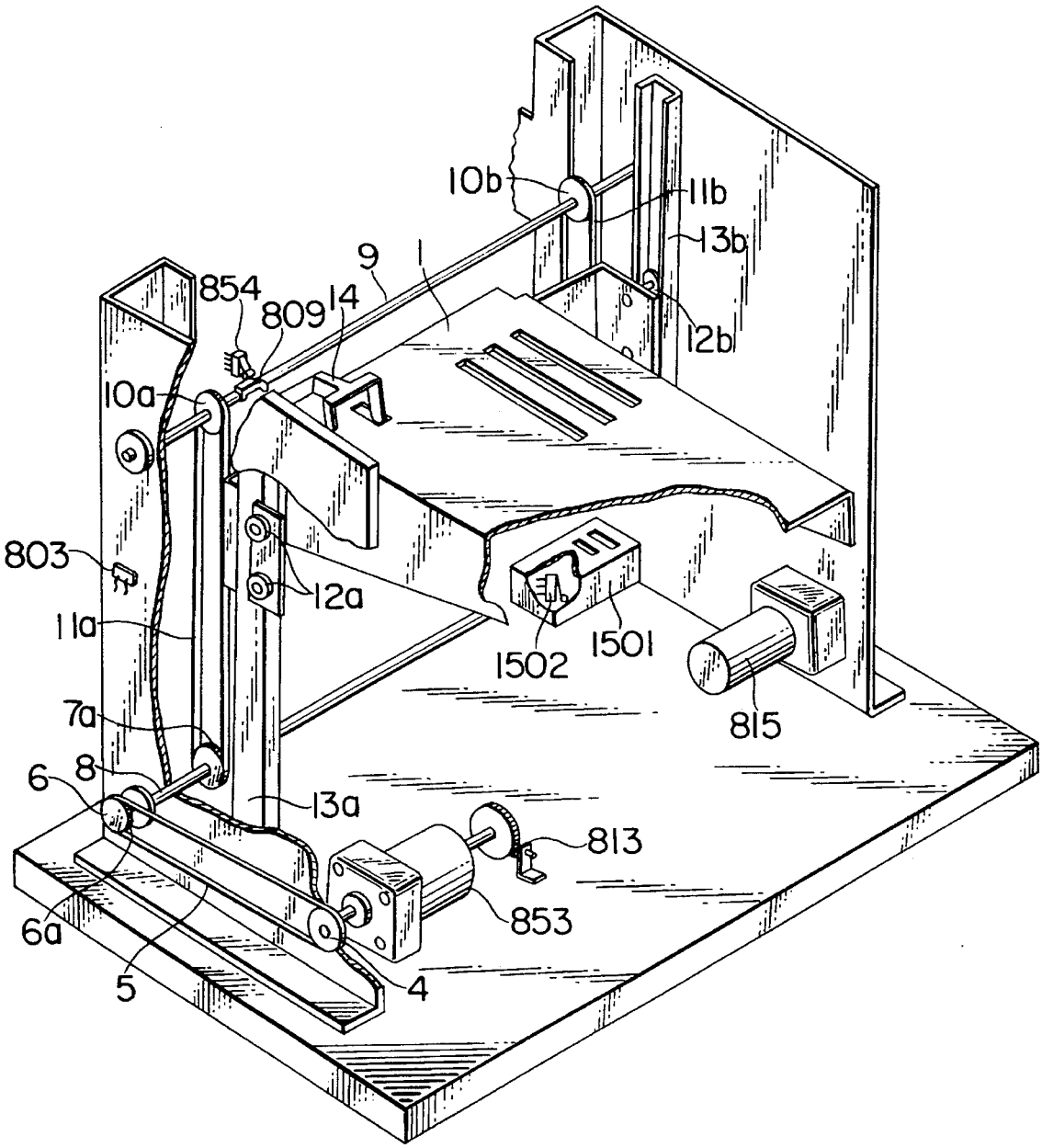
FIG. 14 is a view showing another structure of a paper size detecting section.

Alternatively, the paper size may be detected by a microswitch mounted on a support box 1501 shown in FIG. 14 and mounted on the chassis bottom or side plate.

Figure 15A:
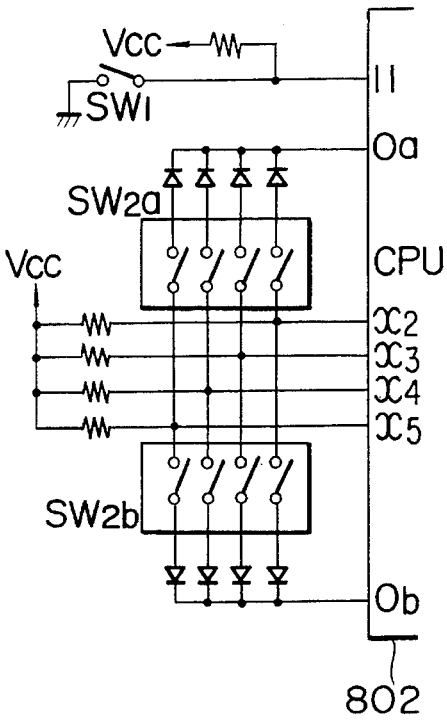
FIG. 15, composed of FIGS. 15A to 15E, is a circuit diagram showing the configuration of another paper size data input means.

Referring to FIG. 15A, when the paper size data is supplied to the CPU 802 and the paper transfer stop timing data is selected in accordance with such data, a similar effect may be obtained.

Figure 15B:
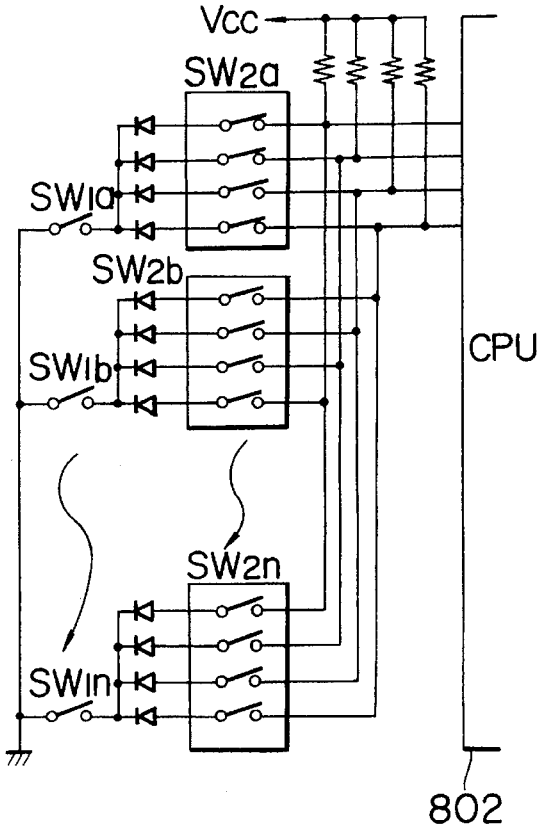

FIG. 15B shows a case wherein more than one type of paper size data are required.

Figure 15C:
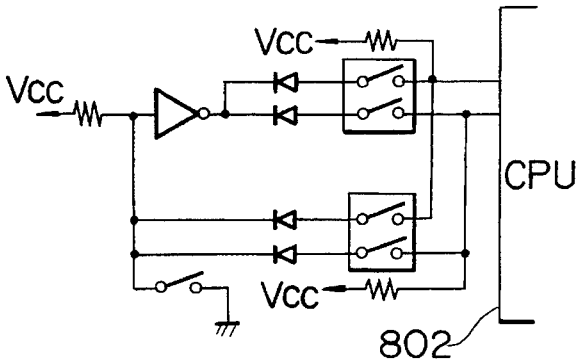

FIG. 15C shows a case wherein the paper size is selected using an ON-OFF switch and an inverter.

Figure 15D:
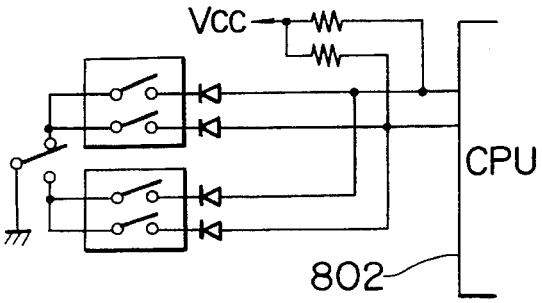
Figure 15E:
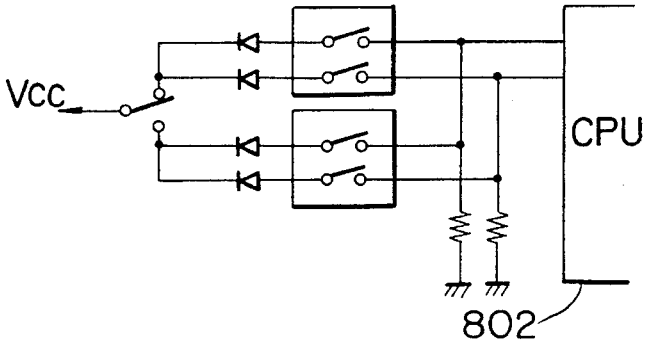

FIGS. 15D and 15E show modifications wherein transfer contacts are used.

In this manner, when a first detecting means at the transfer section of the paper feeding device detects the state of no paper, paper sheets on the plate are placed in the wait mode for transfer to the transfer section. When a second detecting means detects the state of no paper, the paper sheets which are in the wait mode are transferred to the transfer section. Accordingly, when the paper sheets are at the transfer section, the transfer section and storage section can be operated independently of each other. For this reason, a jamming or the like may hardly be caused during the feeding of the paper sheets to the storage section and the inoperative state of the paper feeding device. Furthermore, paper sheets may be efficiently transferred during high-speed feeding, thereby realizing a paper feeding device which has a high processing speed and which causes a defective paper feed such as jamming less frequently.

The device of the present invention can also have a paper state signal transmission means equivalent to that in a case wherein a paper cassette is mounted. Therefore, the paper detecting means incorporated in a recording apparatus main body such as a printer need not be modified. The device of the present invention can also be easily mounted/dismounted to and from the recording apparatus, so that the device is a general purpose machine.

In the device of the present invention, when the drive motor is stopped during the upward movement of the mid plate, the motor is stopped or the mid plate is moved downward. After a predetermined time has elapsed since the motor is stopped, the mid plate is fixed in position. Accordingly, the mid plate is not moved during the fixing unit therefor is in motion. Accordingly, the mid plate is fixed at an optimal timing, so that no variation in the position of the fixed plate is caused and the plate is fixed at a very high precision.

The lifter position detecting means detects the state of no paper before detection of the lowermost position of the lifter for allowing paper feed is released after there is no paper sheet on the lifter. For this reason, the state of no paper sheet may be immediately detected without requiring the upward control of the lifter.

The material of the paper sheets on the mid plate, especially, the light transmission factor thereof is not particularly limited, so that the device of the present invention may be used for a wide variety of applications.

In accordance with the device of the present invention, the timing for stopping the transfer section is controlled in accordance with the paper size. For example, for a letter size paper the timing would be different than for a legal size paper; i.e., the number of clock pulses may be different depending on the sheet size. Accordingly, the adverse effect of a transfer load which changes in accordance with the selected paper size may be eliminated. This allows reliable stopping of the transfer section irrespective of the paper size. Since the paper detecting section can be mounted at any position, few structural limitations are imposed, and ultra high-speed feeding may be allowed for continuous paper feed.

The stopping position of the transfer section is determined in accordance with the paper size and not in accordance with the position of the leading or trailing end of the paper sheet. Thus, even if the operating point of the paper pickup means is at the central portion of the paper sheet or the like, the device can reliably operate. The present invention thus realizes a paper feeding device for any type of paper feed such as paper feed with a robot arm or the like.

When an abnormal upward movement of the lifter is detected, the paper feed level is maintained so as to allow the lifter to move downward to the position where the paper sheets may be fed from the lifter. Such a measure against an abnormal upward movement of the lifter allows correction against erratic operation of the device.

An abnormality processing is performed when an abnormal upward movement of the lifter is detected continuously exceeding a predetermined period of time or when such abnormal upward movement is detected more than a predetermined number of times within a predetermined period of time. Therefore, correction against erratic operation may be easily performed, and the equipment may be protected against damage.

When a switching element such as a diode is connected in parallel with an overrun detecting system, a current flows through the switching element upon operation of the overrun detecting element in a period except the period of movement of a movable member in a specific direction. Thus, no potential difference is established across the overrun detecting element, so the overrun of the movable member is not erroneously detected. In such a case, interruption of processing or processing for abnormality need not be performed. Accordingly, a high reliability is obtained with a simple circuit configuration.

When the paper feeding device of the present invention is not mounted on a recording apparatus, paper feeding to the transfer section is prohibited, and the operation which might result in erratic operation is stopped, thereby realizing a paper feeding device which has a high reliability and which is easy to use.

A description will now be made wherein the lifter up control is not performed when the paper sheets are being picked up from the lifter. In this case, when a number of stacked paper sheets are individually fed, a defective paper feed or erratic operation may be caused due to slight changes in the ambient environment such as a ramp in the paper sheet, simultaneous feed of more than one sheet, or defective pickup. In order to prevent this, in a paper feeding device wherein a number of paper sheets on a lifter are individually fed to a main body by a pickup roller, control for keeping the contact pressure between the pickup roller and the paper sheet constant is not performed during the feed operation.

This embodiment will now be made with reference to the accompanying drawings.

Figure 16:
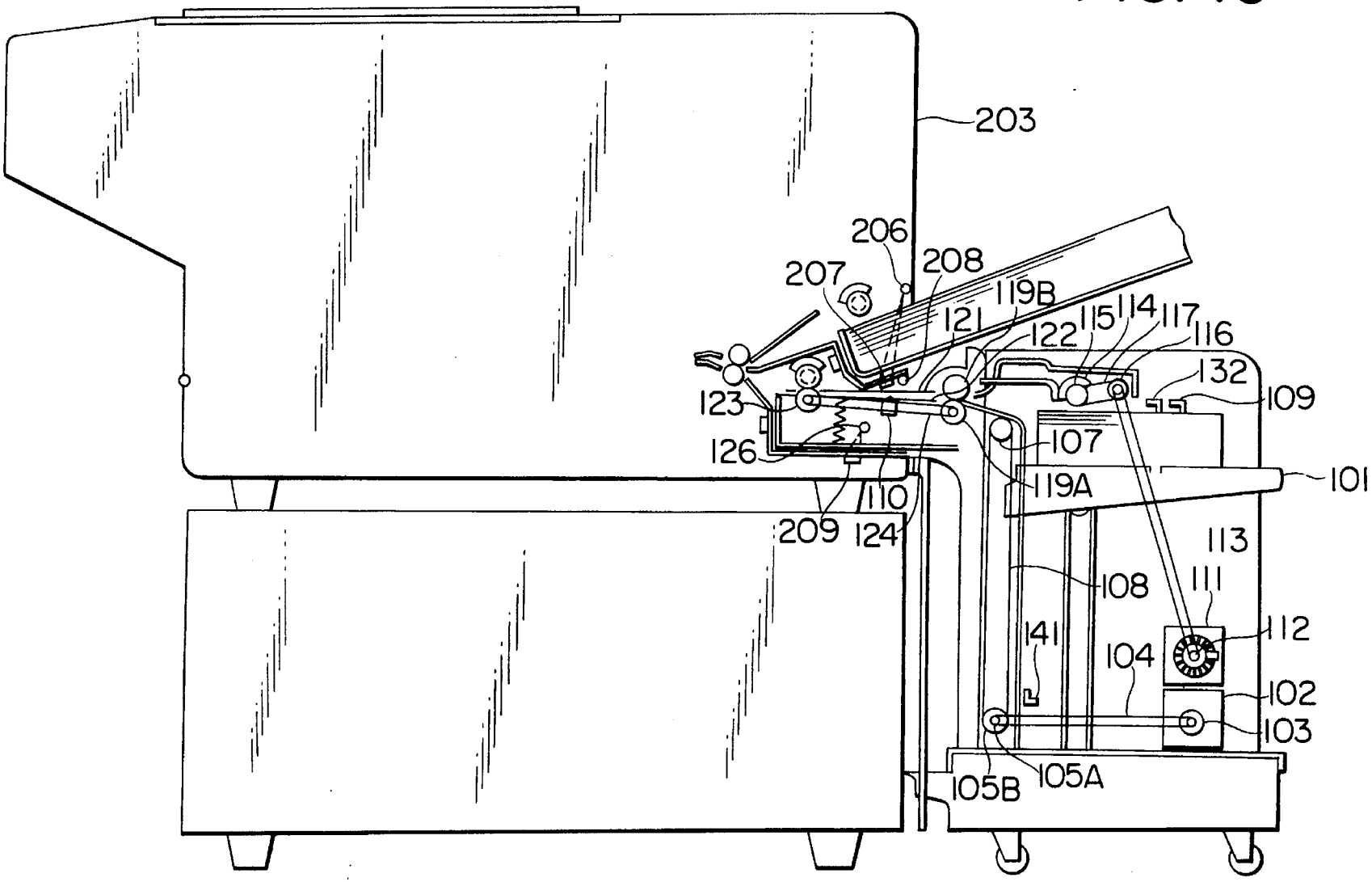
FIG. 16 is a view showing the internal construction when a paper feeding device according to another embodiment of the present invention is mounted on a copying machine.
Figure 17:
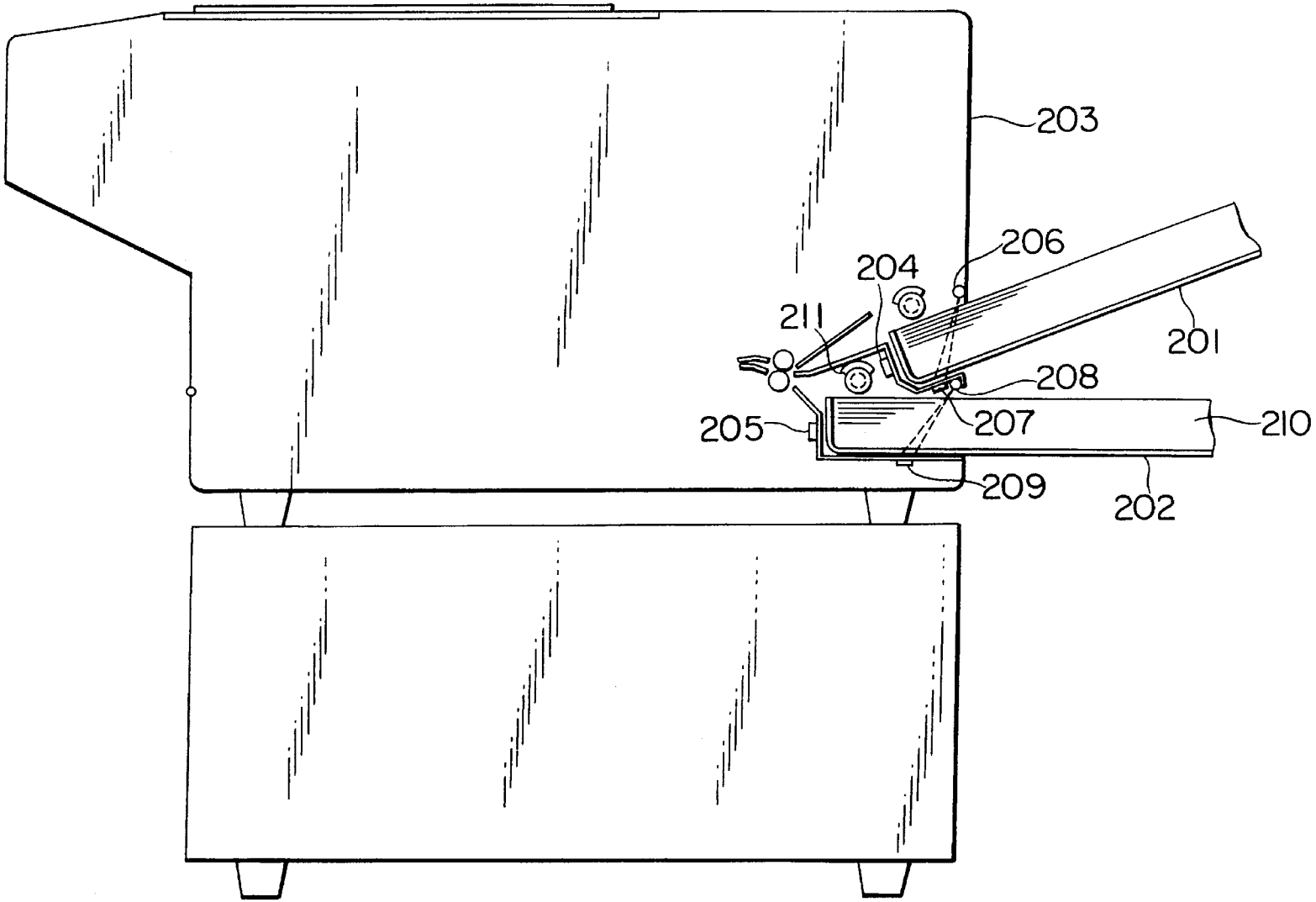
FIG. 17 is a view showing the internal construction when a paper cassette compatible with the device shown in FIG. 16 is mounted on a copying machine.
Figure 18:
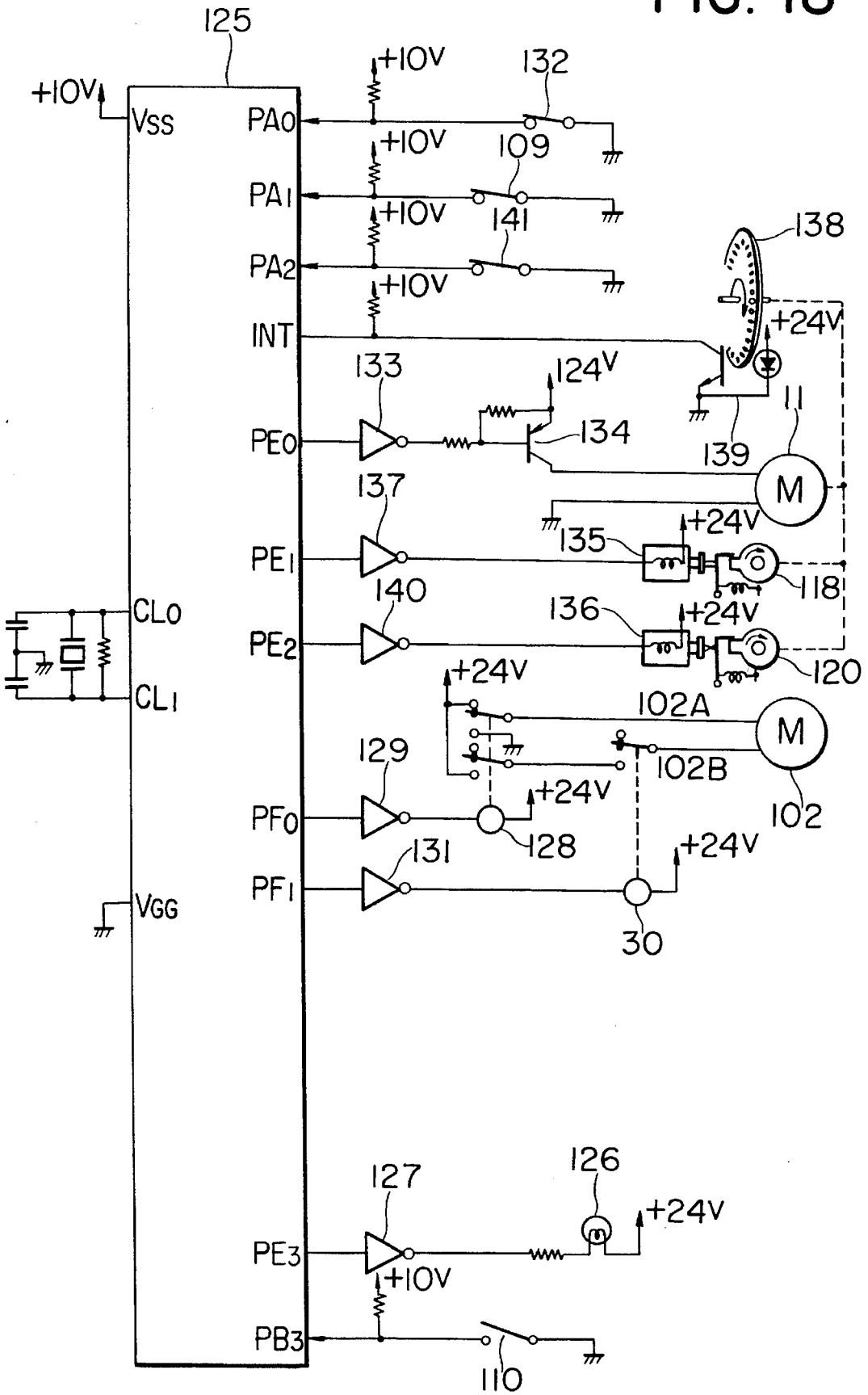
FIG. 18 is a circuit diagram of a control circuit of the device shown in FIG. 16.

FIG. 16 is a view showing the internal state wherein a paper feeding device of this embodiment is mounted on a printer main body 203. FIG. 17 is a view showing the internal state wherein the paper feeding device shown in FIG. 16 and a paper cassette compatible therewith are mounted on the printer main body 203. FIG. 18 shows a circuit diagram of a main control section of the paper feeding device shown in FIG. 16.

Referring to FIG. 16, a lifter or deck 101 moves to a lowermost position to allow replenishment of paper sheets. Upward/downward movement of the lifter 101 is performed by a lifter motor 102. A sprocket 103 is fixed on the output shaft of the lifter motor 102. Driving force is transmitted from the output shaft to a sprocket 105A via a chain 104. Another sprocket 105B is fixed on the sprocket 105A, and a chain 108 is looped around the sprockets 105B and 107. The lifter 101 fixed to the chain 108. When the motor 102 rotates, the lifter 101 is lifted.

When the lifter 101 is lifted and reaches a pickup level, a level sensor 109 is actuated and the motor 102 is stopped. Then, the feed standby state is set.

A paper sensor 110 is arranged on the paper transfer path so as to detect the presence/absence of the paper sheet on the transfer path and to detect the passage of the trailing end of the paper sheet.

When there is no paper sheet on the transfer path in the paper feed standby state as described above, a feed system to be described below is actuated.

The paper feed system is energized by the rotation of a transfer motor 111. A pulley 112 is fixed on the motor 111. The driving force of the motor 111 is transmitted to a pulley, an idler and a feed input gear (not shown) through a belt 113.

A pickup roller 114 is fixed on a feed pulley 115, and the driving force is transmitted through a pulley 116 and a belt 117. The feed input gear mentioned above transmits the driving force of the motor to the pulley 116 through a one-rotation clutch 118 (FIG. 18). With this configuration, while the one-rotation clutch 118 is actuated, the pickup roller 114 keeps rotating.

As the pickup roller 114 rotates, the uppermost paper sheet on the lifter is fed onto the transfer path and reaches paired first transfer rollers 119A and 119B. Also, at a predetermined timing, another one-rotation clutch 120 is actuated. Thus, the transfer roller 119A receives the driving force from the above-mentioned feed input gear through the one-rotation clutch 120. The outer diameter of the transfer roller 119A and the rotating frequency thereof during the force transmission are so determined that when the one-rotation clutch 120 on the transfer path rotates once, the paper sheet is transferred to a distal end position of the transfer path.

The paper sheet is guided between guides 121 and 122. A second transfer roller 123 is interlocked with the transfer roller 119A through a belt 124. When the paper sheet reaches the distal end position of the transfer path, the second transfer roller 123 stops rotating.

In this manner, the paper sheet is constantly placed on the transfer path, so that it may be fed to the printer main body 203 any time.

The mode of operation of the device will now be described with reference to a case wherein the device and a paper cassette are mounted on the printer main body 203 at the same time. Referring to FIG. 17, an upper cassette 201 and a lower cassette 202 are inserted into the printer main body 203. A switch 204 detects the presence/absence of the upper cassette 201, and a switch 205 detects the same of the lower cassette 202. A lamp 206 is paired with a photosensor 207 so as to constitute a no paper sensor for detecting the no paper state of the upper cassette 201. Similarly, a lamp 208 and a photosensor 209 constitute a no paper sensor for detecting the no paper state of the lower cassette 202. Assume that the lower cassette 202 is selected by the main body 203 and the lower cassette 202 is correctly inserted. Then, the presence of the lower cassette 202 is detected by the lower cassette detecting switch 205. A paper sheet 210 shields light irradiated from the lamp 208 toward the photosensor 209. Therefore, the indication changes from "no paper" to "paper present". Thus, the printer can start its operation. When the printing operation is started, a pickup roller 211 of the printer is rotated, and the uppermost paper sheet in the lower cassette 202 is fed.

The control operation of the case wherein the paper feeding device is mounted on a printer main body will now be described.

Control of the paper feeding device may be performed by a microcomputer. FIG. 18 shows an example of such a microcomputer. The microcomputer may be a one-chip microcomputer 125 such as an NEC μCOM 43. The microcomputer 125 has input ports $PA_0$, $PA_1$, $PA_2$, INT (interrupt) and $PB_3$, and output ports $PE_0$, $PE_1$, $PE_2$, $PE_3$, $PF_0$ and $PF_1$.

Figure 19A:
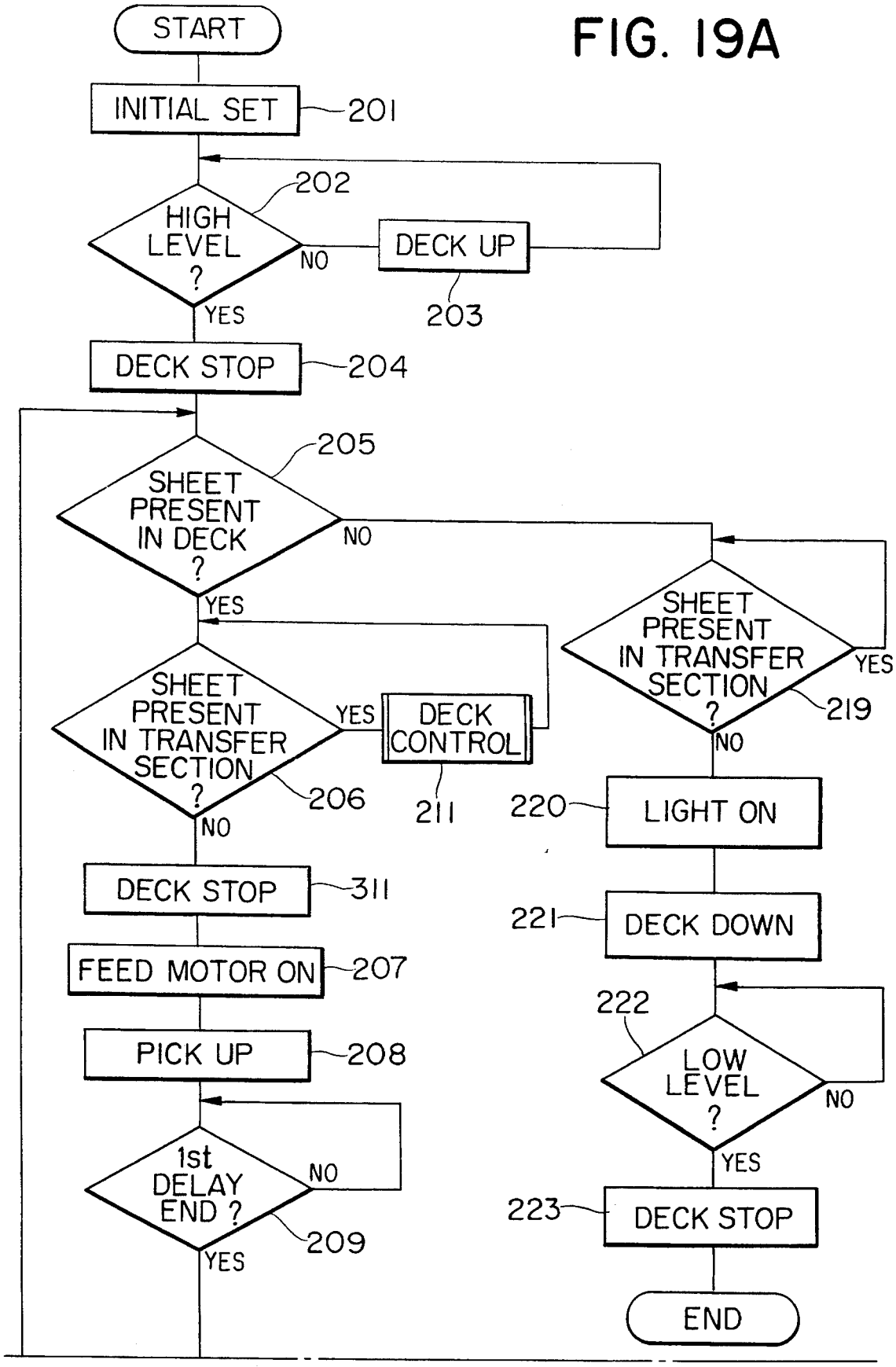
FIG. 19, composed of FIGS. 19A and 19B, and FIG. 20 are flow charts showing the control programs of a paper feeding device of the present invention.
Figure 19B:
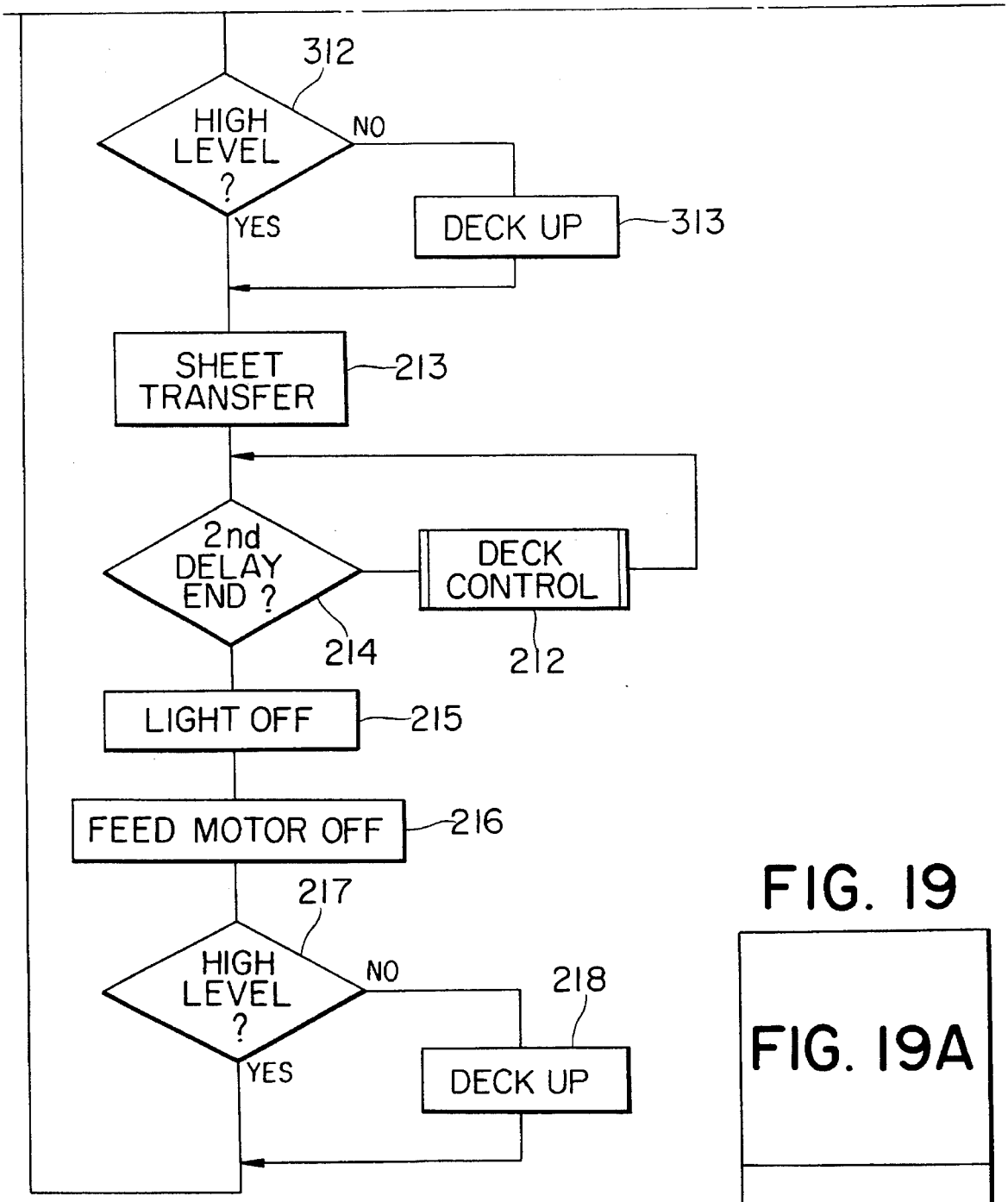
Figure 19:
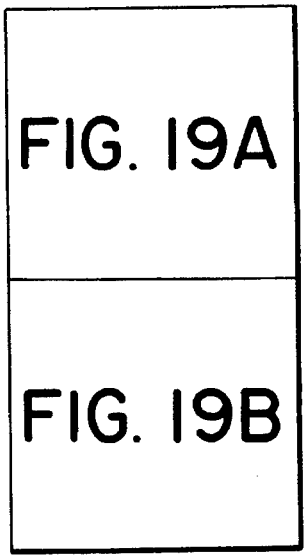
Figure 20:
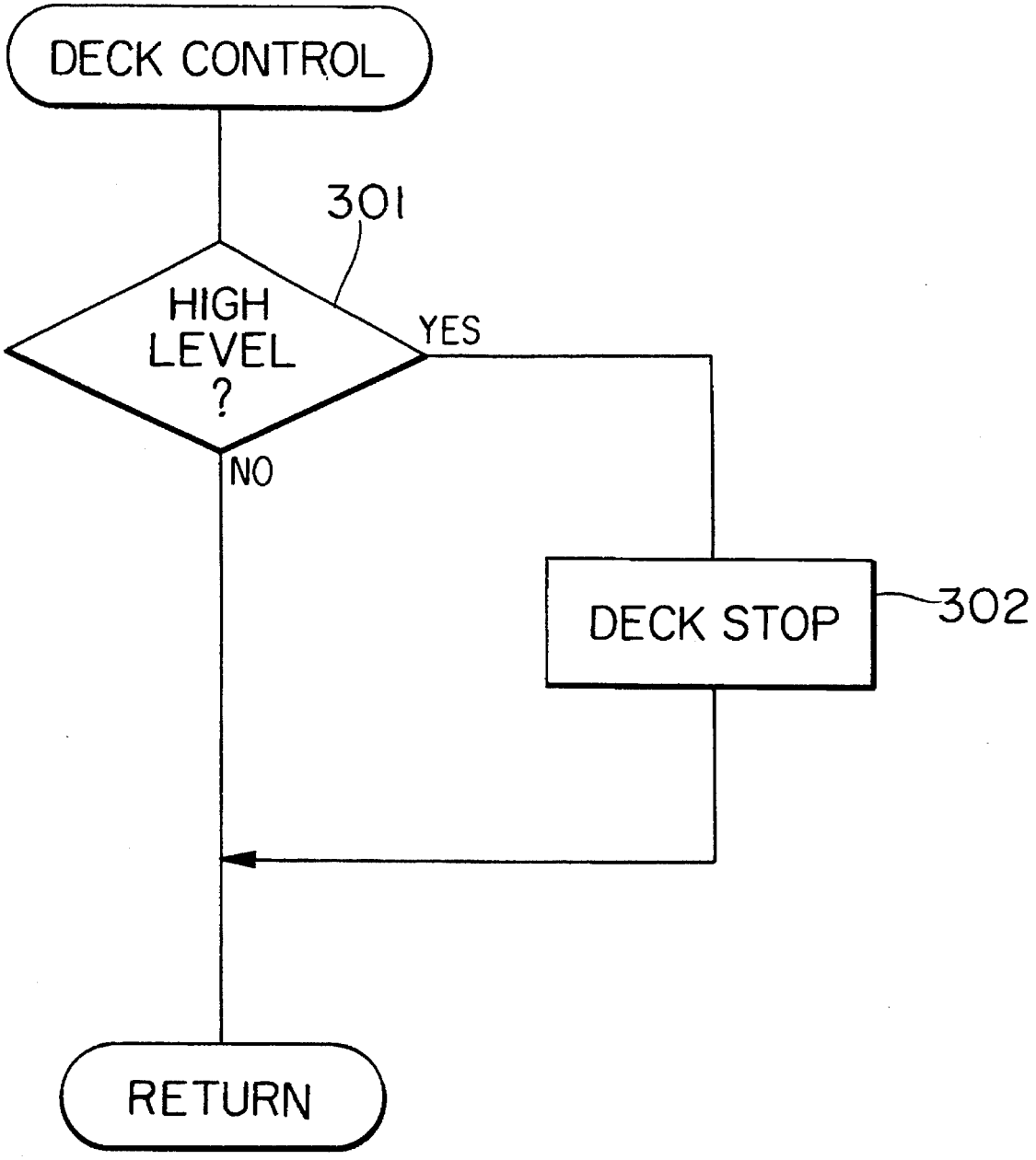

FIGS. 19 and 20 show flow charts for explaining an example of a control program stored in the microcomputer computer 125. As has been described above, the lifter 101 is at the lowermost position during the replenishment of paper sheets. When the preparation for operation is completed, the control program is started. In order to transmit to the printer main body 203 data indicating the presence/absence of the paper sheet when the paper feeding device is mounted on the printer main body, light from the lamp 208 is correctly shielded by the guides 121 and 122. At the same time, a lamp 126 is arranged at the lower portion of the transfer path so as to irradiate the photosensor 209. For this purpose, the output port $PE_3$ and the lamp 126 are connected through a hammer driver 127.

In step 201 in FIG. 19, the microcomputer 125 is initially set. Then, the output port $PE_2$ goes high and the lamp 126 is turned on. The printer main body determines that there is no paper sheet. In step 202, a detection signal from the photosensor 209 is received at the input port $PA_1$ so as to check if the uppermost paper sheet is at a predetermined position. Since the deck 1 is at its lowermost position, the flow advances to step 203. In step 203, an OFF signal for a relay 128 is produced from the output port $PF_0$ so as to lift the deck 101. When the relay 128 is connected to the output port $PF_0$ through a hammer driver 129, a signal of low level is produced from the output port $PF_0$ so as to turn off the relay 128. Then, preparation for applying a power source voltage of +24 V to a terminal 102A of the lifter motor 102, and a GND potential of 0 V to a terminal 102B thereof is completed. In the initial state, an OFF signal for a relay 130 connected to the output port $PF_1$ through a hammer driver 131 is produced from the output port $PF_1$. Accordingly, the lifter motor 102 is stopped irrespective of the output from the output port $PF_0$. This is because the motor 102 is not rotated since no voltage is applied thereto. When an ON signal of the relay 130 is produced from the output port $PF_1$, a power source voltage of +24 V is applied to the terminal 102A of the lifter motor 102, while a GND potential of 0 V is applied to the terminal 102B thereof. Then, the deck 101 starts being lifted. Since step 203 forms a loop, the flow returns to step 202. When the deck 101 is lifted and the paper sheet is urged against the level sensor 109 with a predetermined pressure, the control flow advances to step 204.

In step 204, an OFF signal of the relay 130 is produced from the output port $PF_1$. Then, the rotation of the lifter motor 102 is stopped. In step 205, the state of a paper sensor 132 connected to the input port $PA_0$ is tested. If YES in step 205, the sensor 132 is turned off. If NO in step 205, the sensor 132 is turned on. This may be accomplished with a microswitch and a deck with a hole corresponding to the microswitch. Since there is a paper sheet on the deck 101, the flow advances to step 206.

In step 206, the state of the paper sensor 110 described above on the transfer path is checked. If there is a paper sheet on the transfer path, deck control as shown in FIG. 20 is performed in step 211. This will be described in detail later. Since there is no paper at the beginning, the lifting of the deck 101 is temporarily stopped in step 311 and the flow goes to step 207. In step 207, a signal of high level is produced from the output port $PE_0$ so as to turn on a hammer driver 133. This turns on a transistor 134 and rotates the transfer motor 111. The clutches 118 and 120 are stopped by plungers 135 and 136. Therefore, the transfer system is not still operating.

In step 208, the output port $PE_1$ is set at high level. Upon this operation, a hammer driver 137 is turned on and the plunger 135 is pulled so as to remove the outer ring of the clutch 118. Then, the clutch 118 starts rotating to feed the paper sheet. Subsequently, the output port $PE_1$ is set at low level to return the plunger 135. However, the clutch 118 does not stop until it completes one rotation.

In step 209, end of a first delay time for allowing the paper sheet to reach the rollers 119A and 119B is checked. The first delay time may be determined mined in the following manner. A slotted disc 138 is mounted on the transfer motor 111 and is sandwiched between a photointerruptor 139. An output signal from the photointerruptor 139 is connected to the input port INT of the microcomputer 125. Changes in this output signal are counted to determine the first delay time. When the paper sheet reaches the rollers 119A and 119B after the first delay time elapses, it is discriminated in step 312 if the height of the deck 101 is proper by means of the level sensor 109. If the deck 101 is low, the flow goes to step 313 to drive the motor 102 to move the deck upward and the flow goes to step 213. In step 213, a signal of high level is produced from the output port $PE_2$. Then, a hammer driver 140 drives the plunger 136 to remove the outer ring of the clutch 120. Then, the rollers 119A and 119B rotate, the paper sheet is fed onto the transfer path, and the preparation for feeding the paper sheet to the printer main body is completed. This is similar to the case of step 208. That is, even if a signal of low level is produced from the output port $PE_2$ to turn off the plunger 136, the one-rotation clutch 120 rotates once. Accordingly, the paper sheet is transferred to a predetermined position.

In step 214, end of a second delay time for allowing the paper sheet to be transferred to a predetermined position is checked. Then, the deck control as in step 211 is performed. The deck control will now be described. In steps 211 and 212, as shown in FIG. 20, it is discriminated in step 301 if the deck 101 is moved upward and the paper sheet is in contact with the level sensor 109. If YES in step 301, the rotation of the lifter motor 102 is stopped to stop moving the deck 101 in step 302. That is, when a predetermined number of paper sheets are not present on the deck after some paper sheets are fed onto the transfer path, paper sheets cannot be subsequently fed before the deck 101 reaches a predetermined position. Then, during this time, the state of no paper occurs.

In order to prevent this from occurring, the deck 101 is moved upward in step 218 to be described later. The stop of the deck 101 is monitored/controlled in steps 211 and 212. When the turning on/off of the plunger must be delayed in step 208 and the like, the deck control program as shown in FIG. 20 may be executed any time.

When it is determined in step 214 that the second delay time has elapsed and the paper sheet has reached the predetermined position, the lamp 126 is turned off (output port $PE_3$) in step 215. Then, the light is no longer received by the photosensor 209 of the printer main body, so that the main body can pick up paper sheets at any time.

In step 216, the output port $PE_0$ is set at low level so as to stop the transfer motor 111. Similar control to that in steps 312 and 313 is performed in steps 217 and 218, and thereafter the flow returns to step 205. The above-mentioned control is performed until no paper sheet is left on the deck.

When no paper sheet is left on the deck 101, the flow advances from step 205 to step 219. When the printer main body picks up the paper sheet and there is no paper sheet on the transfer path, the flow advances to step 220. The lamp 126 is turned on, light becomes incident on the photosensor 209, and the printer main body 203 detects the state of no paper sheet.

In step 221, a signal of high level is produced from the output port $PF_0$ so as to drive the relay 128 and to switch its contact. Subsequently, the output port $PF_1$ is set at high level to drive the relay 130 and to close its contact. Then, a GND potential of 0 V is applied to the terminal 102A of the lifter motor 102, and a power source voltage of +24 V is applied to the terminal 102B thereof. Then, the lifter motor 102 is driven to move the deck 101 downward.

In step 222, it is waited until a level sensor 141 mounted at the lower portion of the printer main body detects that the deck 101 is at its lowermost position. In the next step 223, a signal of low level is produced from the output port $PF_1$ to stop the lifter motor 102. Then, preparation for paper sheet replenishment is completed, and the control program is ended.

In this manner, the position of the deck 101 is adjusted such that the uppermost paper sheet on the deck 101 is urged against the pickup roller 114 at substantially a constant pressure. In step 217, it is discriminated if the deck 101 is at an uppermost position. In step 218, the upward movement of the deck 101 is started.

Even if the deck 101 starts to move upward (steps 218 and 313) for correcting the contact pressure acting between the pickup roller 114 and the paper sheet, the upward movement of the deck 101 may be temporarily stopped in step 311 which is prior to the pickup operation. The paper sheet is picked up in the state wherein the deck 101 is not moving. If it is determined in the immediately following step 312 that the deck 101 must be moved upward, the deck 101 is moved upward in step 313.

The paper sheet may be picked up stably in the manner as described above.

The control program shown in FIG. 19 is for controlling the deck 101 to be stationary during the pickup operation. This interlock may be achieved by an electric circuit externally attached to the microcomputer 125.

Figure 21:
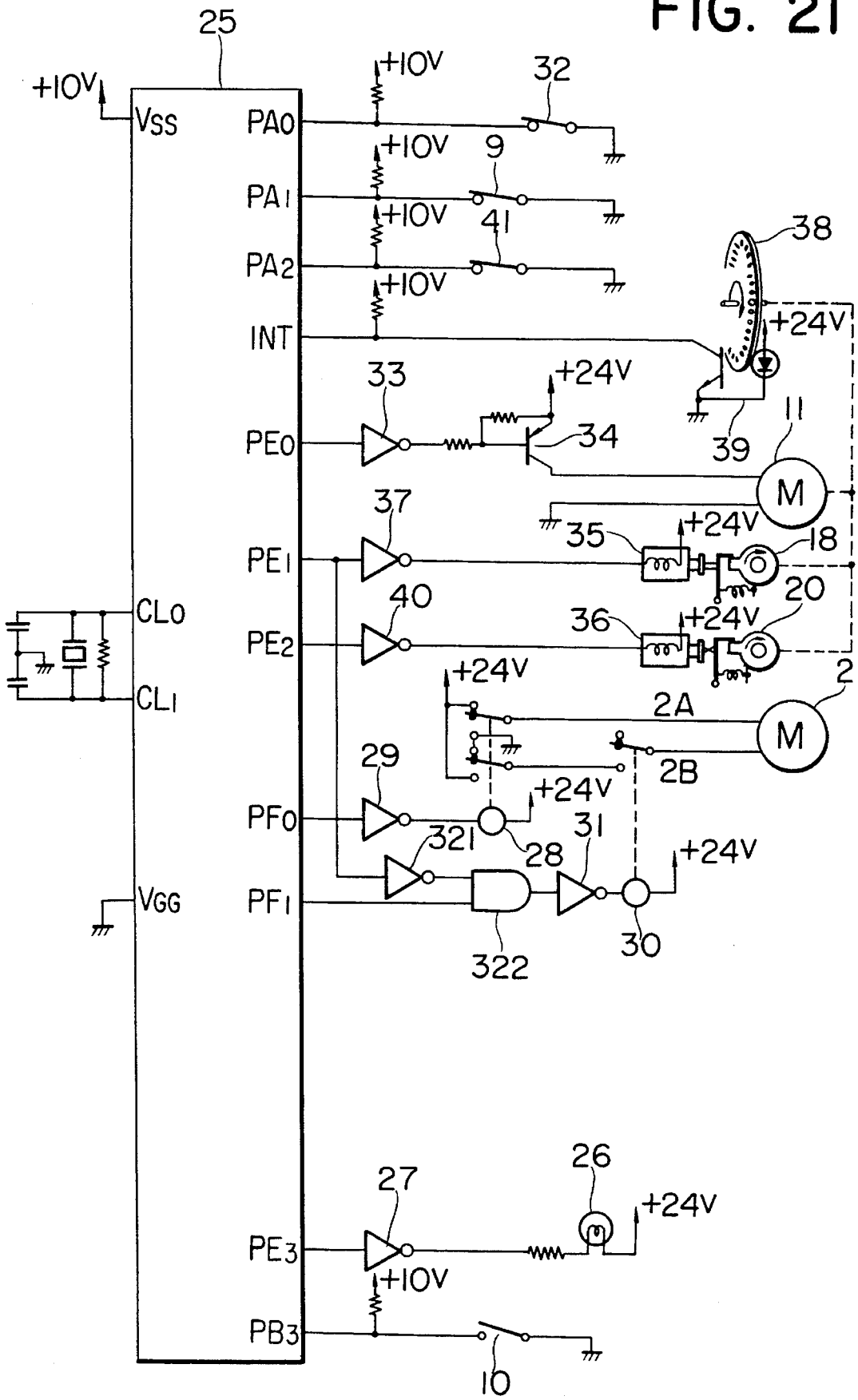
FIG. 21 is a circuit diagram of a main control section of still another embodiment of the present invention.

FIG. 21 is a circuit diagram showing another embodiment of the present invention. The difference between this embodiment and the embodiment shown in FIG. 18 resides in that in this embodiment an output $PE_1$ for driving a one-rotation clutch 118 is connected to a first input end of an AND gate 322 through an inverter 321, an output port $PF_1$ is connected to a second input end of the AND gate 322, and the output end of the AND gate 322 is connected to the input end of a hammer driver 311.

With the circuit configuration as described above, only when the output port $PE_1$ is at low level and the output port $PF_1$ is at high level, a relay 130 is biased. That is, when the output port $PF_1$ is set at high level so as to move the deck 101 upward and the output port $PE_1$ is set at high level after the commencement of the pickup operation, the output from the inverter 321 goes low. Then, the output from the AND gate 322 goes low to stop the motor 102.

In this manner, the movement of the deck 101 may be prohibited during the pickup operation. In this case, the timing for producing a signal of high level from the output port $PE_1$ is adjusted (step 208) so as to adjust the temporary stop time of the deck 101. Then, the upward movement of the deck 101 can be temporarily stopped for a minimum required time, so that the control program may not become complex.

Figure 22:
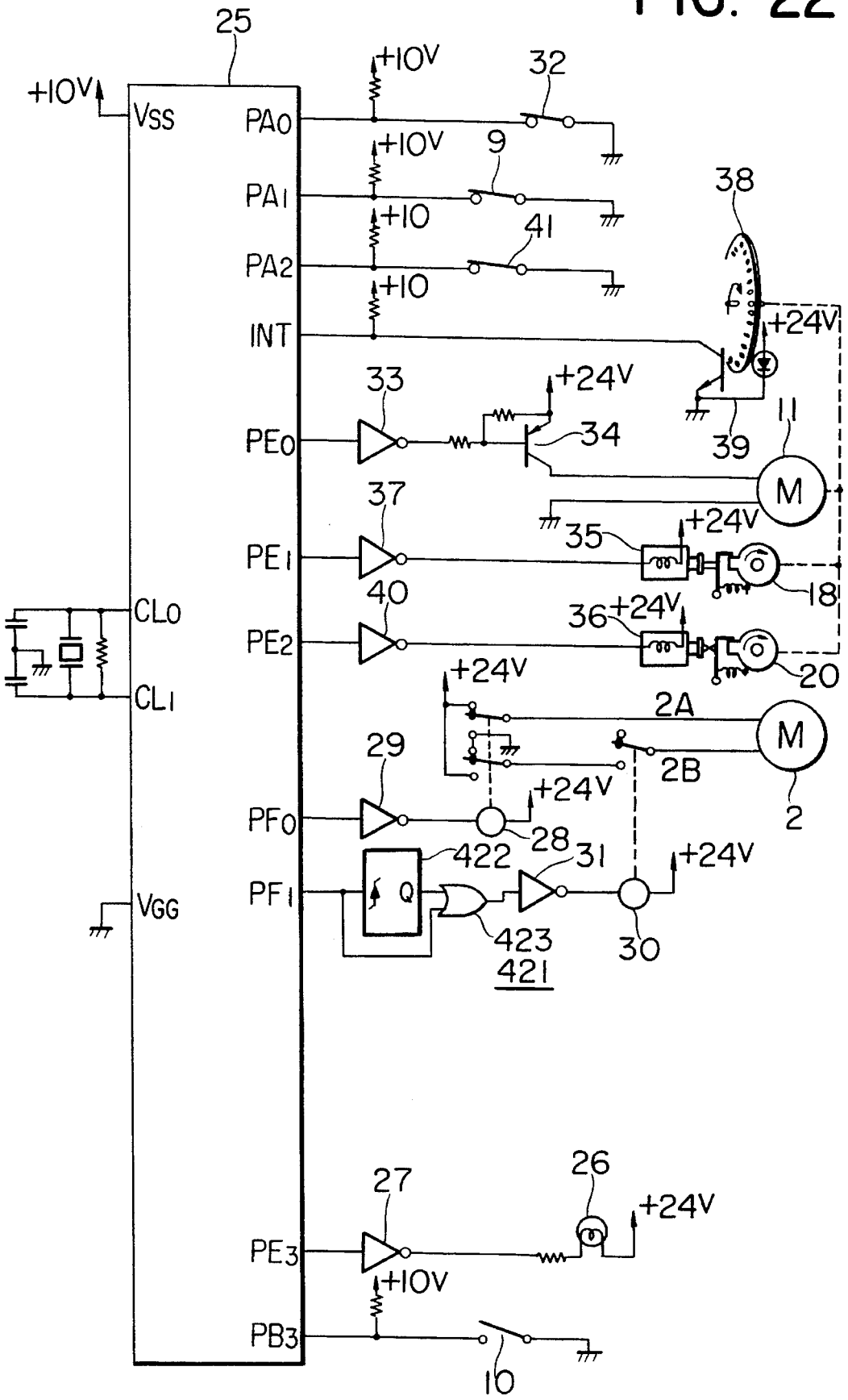
FIG. 22 is a circuit diagram of a main control section of still another embodiment of the present invention.

FIG. 22 is a circuit diagram of another embodiment of the present invention. The difference between this embodiment and the embodiment shown in FIG. 18 resides in the fact that in this embodiment a timer circuit 421 is inserted between an output port $PF_1$ and an inverter 131. The timer circuit 421 produces a signal of high level and of a predetermined duration when the input signal thereto goes to high level. The timer circuit 421 is unaffected even if the input signal thereafter goes to low level. When the input signal is at high level, the output signal from the timer circuit 421 is kept at high level. The timer circuit 421 may comprise a combination of a monostable multivibrator 422 and an OR gate 423.

Figure 23A:
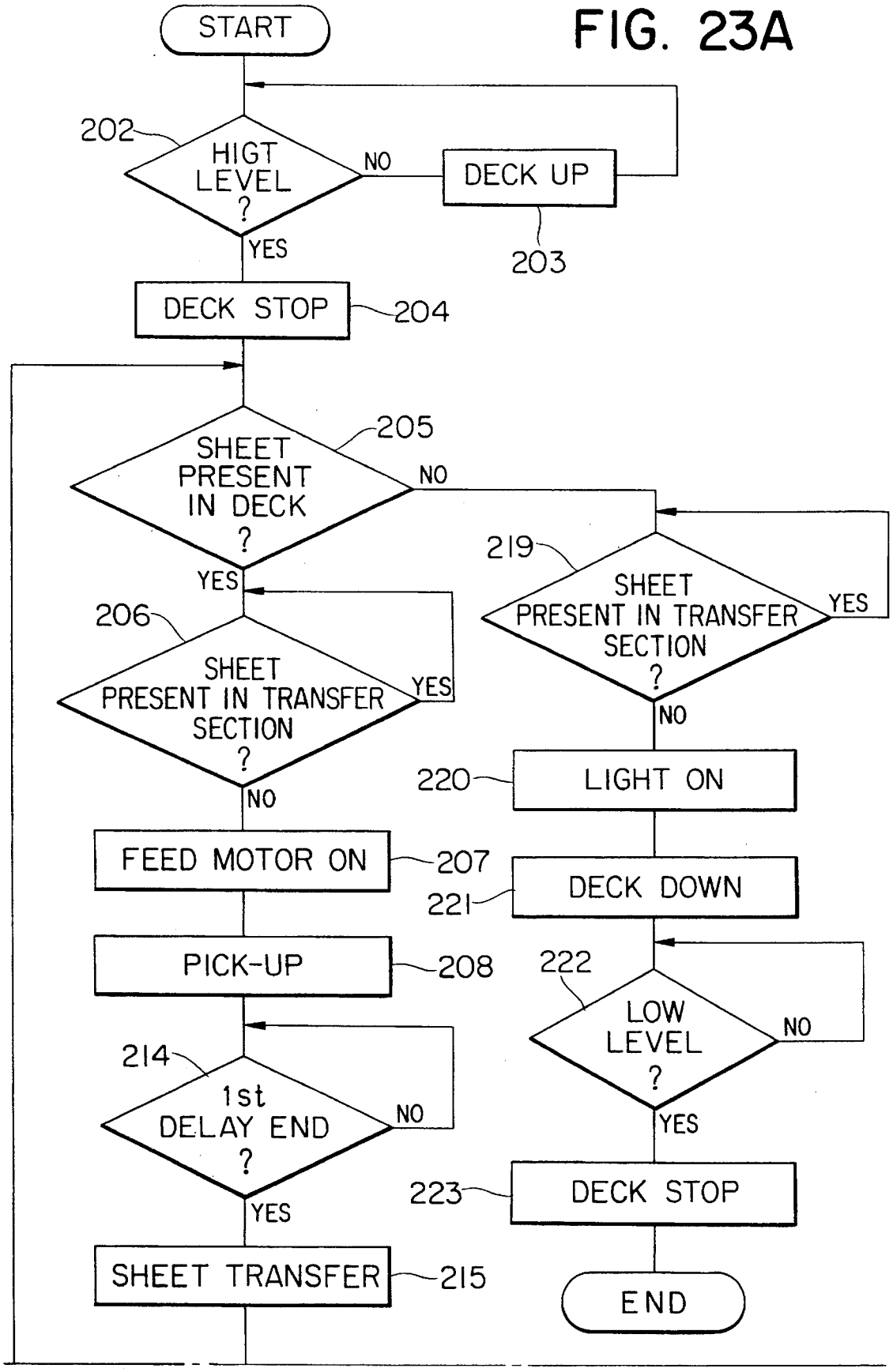
FIG. 23, composed of FIGS. 23A and 23B, is a flow chart of the control program of the circuit shown in FIG. 22.
Figure 23B:
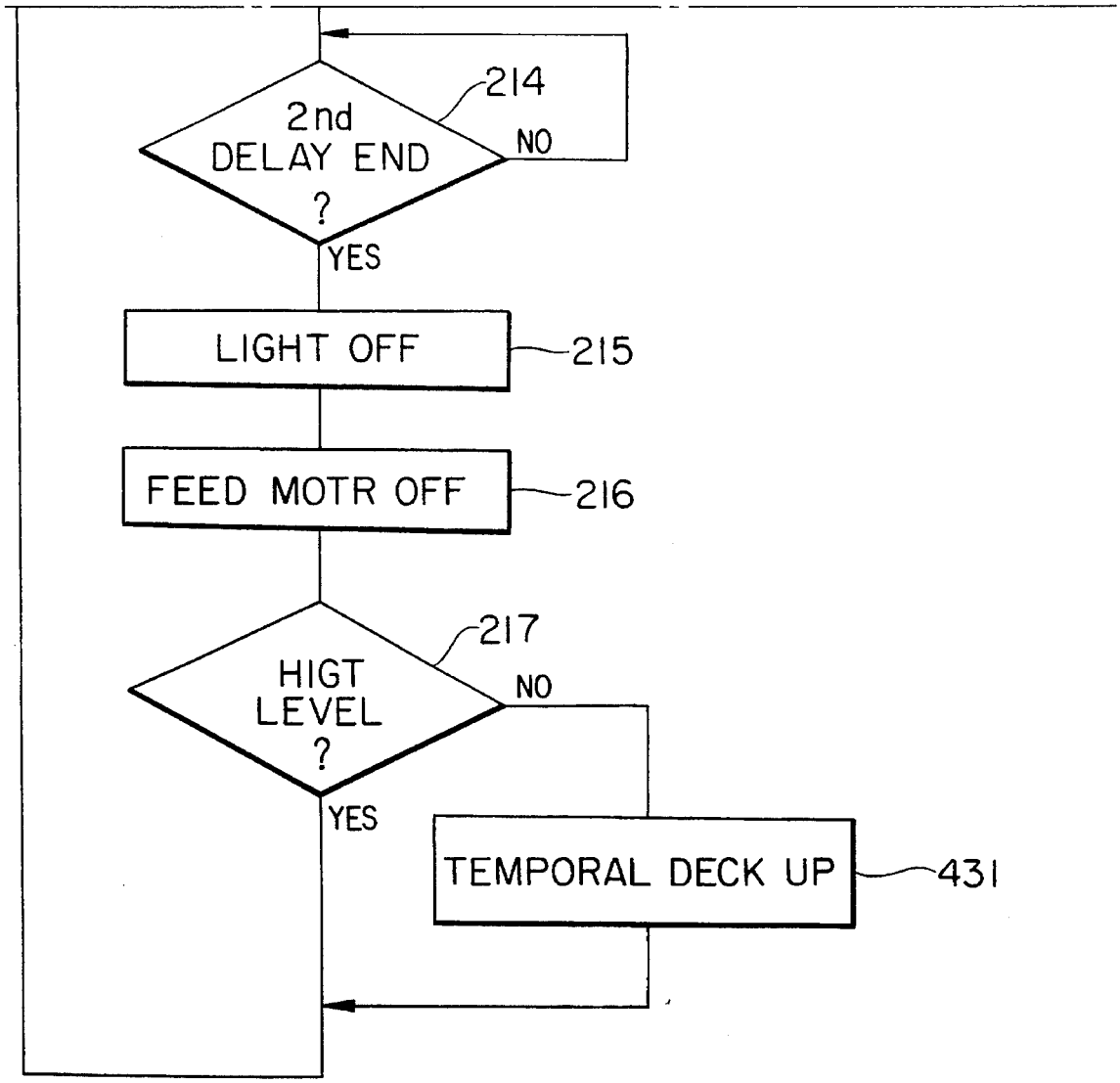
Figure 23:
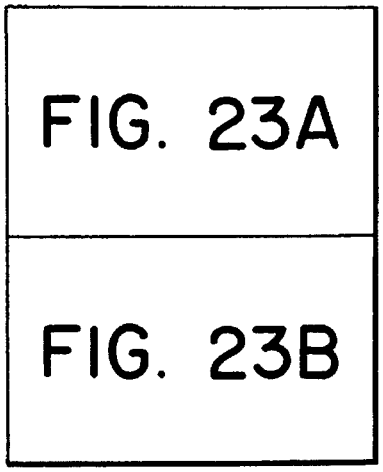

FIG. 23 is a flow chart of the control program of the circuit shown in FIG. 22. The difference between this flow chart and that shown in FIG. 19 is that the content of step 218 in FIG. 19 is changed to step 431, and steps 211, 212, and 311 to 313 in FIG. 19 are omitted. In step 431, the output port $PF_1$ is set at high level once and is immediately returned to low level.

Then, the output from the monostable multivibrator 422 is kept high only for a predetermined time. Then, a signal of high level is produced from the OR gate 423 and a relay 130 is biased through a hammer driver 131. Thus, a deck 101 is moved upward for a predetermined time. After the predetermined time has elapsed, the output port $PF_1$ goes low, and the output from the monostable multivibrator 422 also goes low. Then, the relay 130 is restored, and the upward movement of the deck 101 is stopped. Adjustment of the predetermined time described above may be performed by adjustment of an RC circuit included in the monostable multivibrator 422. However, this predetermined time may not overlap the next pickup operation but must be sufficient to move the deck upward for picking up one paper sheet. When such a control program as described above is used, the stop timing of the deck 101 need not be constantly monitored. Furthermore, since the movement of the deck 101 is prohibited during the pickup operation, the program load of the microcomputer 125 may be reduced.

In summary, since a single paper sheet may be picked up in a stable state wherein the deck is temporarily stopped, a ramp in the paper sheet, simultaneous feeding of more than one paper sheet, or failure to pick up a paper sheet and the like can be prevented.

In the embodiments described above, the operator sets the paper size manually. However, the size of a fed paper sheet may be automatically detected and may be transmitted to a recording apparatus main body. This will now be described below.

Figure 24:
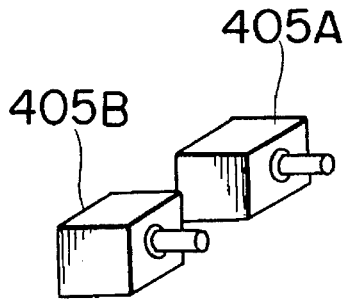
FIG. 24 shows the configuration of a set of paper size detection switches.
Figure 25:
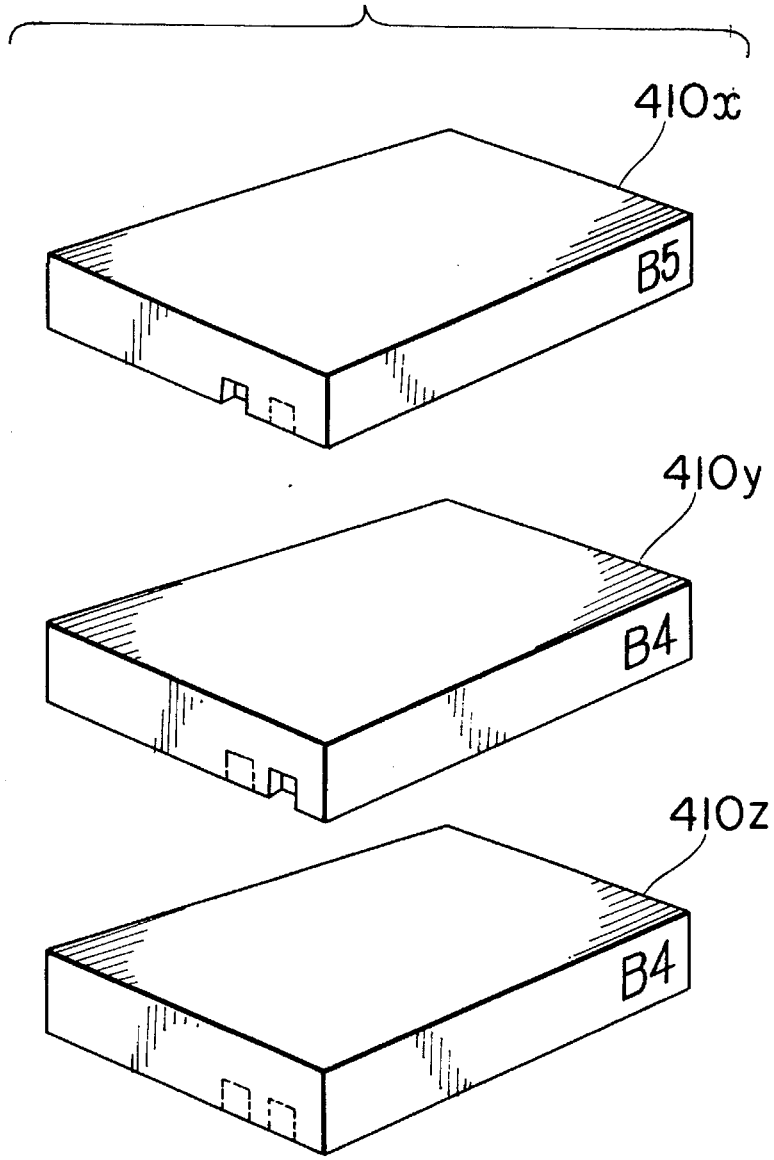
FIG. 25 shows the configuration of a paper size signal transmission mechanism of a cassette.

In a printer such as a copying machine, as a method for detecting a paper size in a cassette is adopted a method wherein a group of size detection switches such as microswitches 405A and 405B are mounted on the copying machine main body, as shown in FIG. 24. Meanwhile, recesses corresponding to varying paper sizes are formed in the cassette, as shown in FIG. 25. For example, a recess is formed in a B5 size cassette 410*x* so as not to depress the microswitch 405A, a recess is formed in an A4 size cassette 410y so as not to depress the microswitch 405B, and no recess is formed in a B4 size cassette 410*z* so that both the microswitches 405A and 405B are depressed.

Various display/indication of the copying machine, scanning operation for exposure by the optical system or the like are controlled in accordance with the detected paper size.

In this embodiment, the paper feeding device has a paper size detecting means. A size detecting means at the side of the recording apparatus main body is actuated in accordance with an output from this detecting means so that the paper size detected at the detecting means of the paper feeding device is transmitted to the detecting means at the main body.

Figure 26:
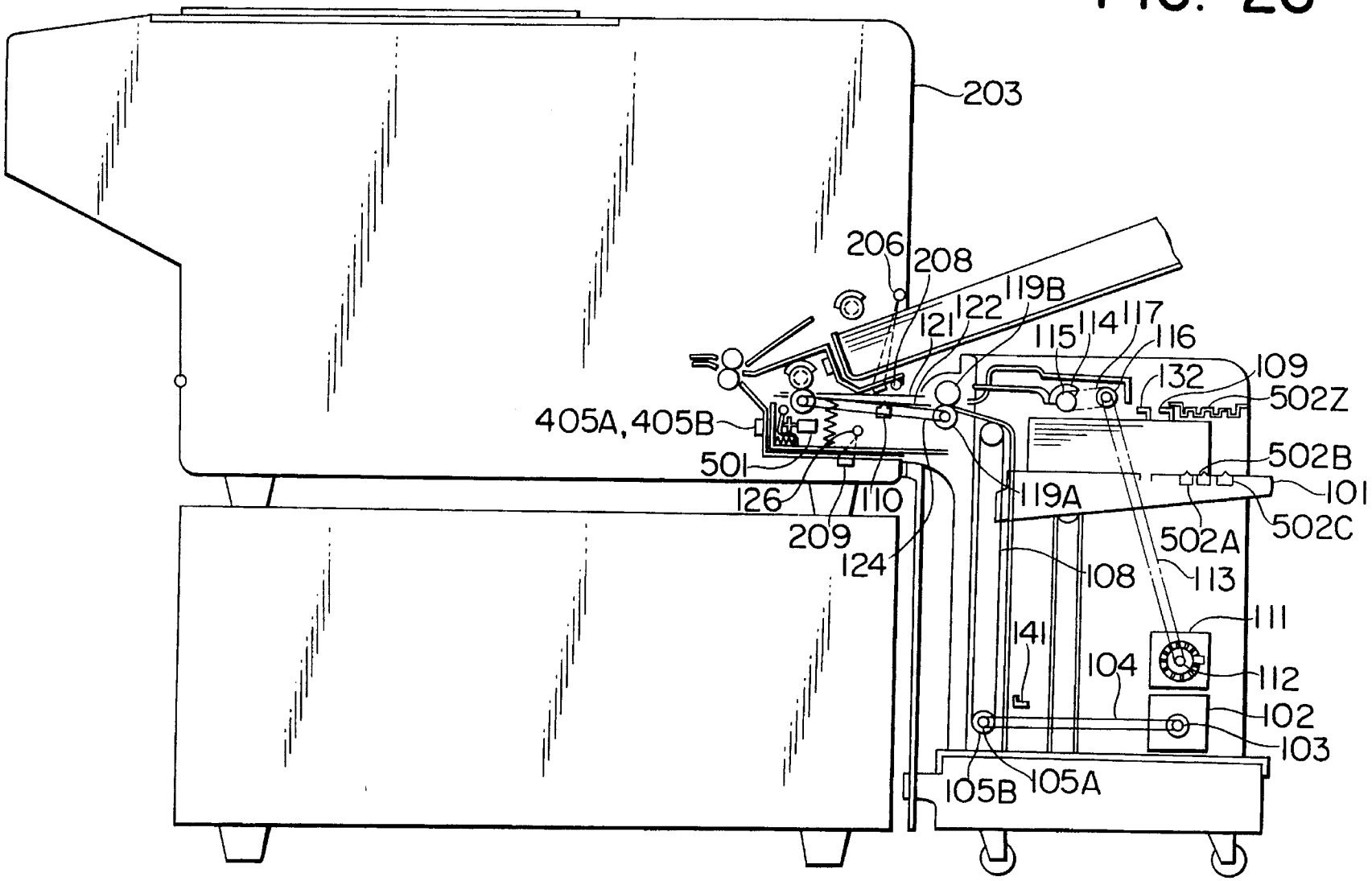
FIG. 26 shows the internal construction of a paper feeding device according to still another embodiment of the present invention which is mounted on a copying machine.
Figure 27:
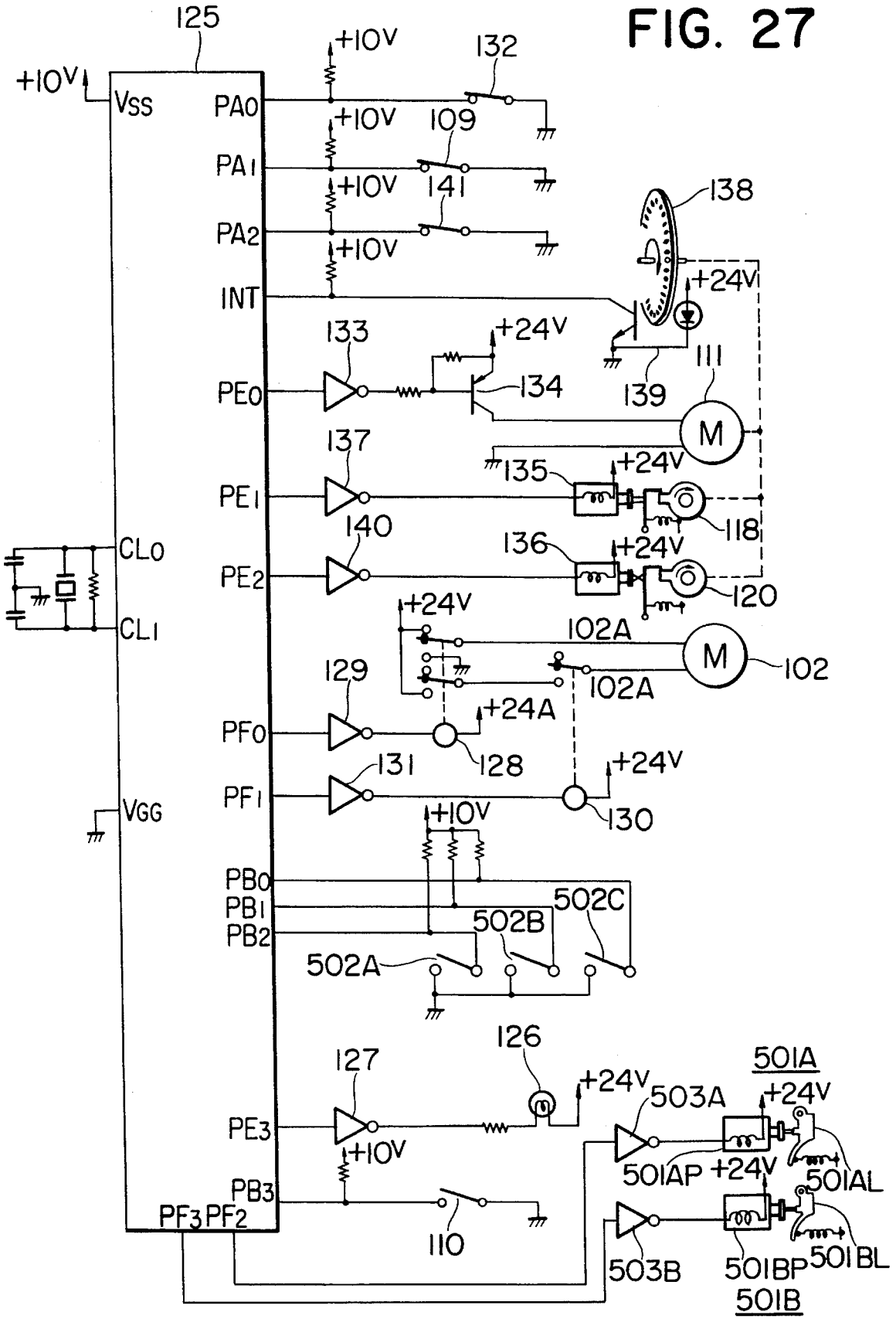
FIG. 27 is a circuit diagram of a main control section of the paper feeding device shown in FIG. 26.

FIG. 26 is a view showing a state wherein a paper feeding device according to this embodiment is mounted on a copying machine main body. Referring to FIG. 26, the same reference numerals as in FIG. 16 denote the same parts. A paper size signal transmission mechanism 501 turns on/off the microswitches 405A and 405B of the of the printer main body. The paper size signal transmission mechanism may comprise mechanisms 501A and 501B as shown in FIG. 27. The mechanism 501A consists of a lever 501AL and a plunger 501AP, and the mechanism 501B consists of a lever 501BL and a plunger 501BP. When the paper feeding device having such a configuration is mounted on a printer main body 203, the microswitch 405A is turned on/off by the mechanism 501A, and the microswitch 405B is turned on/off by the mechanism 501B. Sensors 502A, 502B and 502C detect the paper size and comprise microswitches. The respective microswitches are turned on/off depending upon the difference in the paper size. Paper holders 502Z oppose the sensors 502A, 502B and 502C. The paper holders 502Z have recesses for receiving the head portions of the corresponding microswitches. Thus, when the deck 101 is lifted to a pickup level and no paper sheet is left on the deck 101, the head portions of the microswitches are received in the corresponding recesses in the paper holders 502Z. When some paper sheets are remaining on the deck 101 and the sheets are of B5 size, for example, the sensor 502A alone is turned on and the sensors 502B and 502C are turned off. When the paper size is A4, the sensors 502A and 502B are turned on, and the sensor 502C is turned off. When the paper size is B4, all the sensors 502A, 502B and 502C are turned on.

The paper size sensors operate in this manner.

The control mode wherein the paper feeding device is mounted on a recording apparatus main body such as a printer main body will now be described.

FIG. 27 is a circuit diagram of a main control circuit for controlling the device of this embodiment. The same reference numerals as in FIG. 18 denote the same parts.

The sensors 502C, 502B and 502A are connected to input ports $PB_0$, $PB_1$ and $PB_2$, respectively, of the microcomputer 125. The paper size signal transmission mechanisms 501A and 501B are connected to output ports $PF_2$ and $PF_3$, respectively, through hammer drivers 503A and 503B.

Figure 28A:
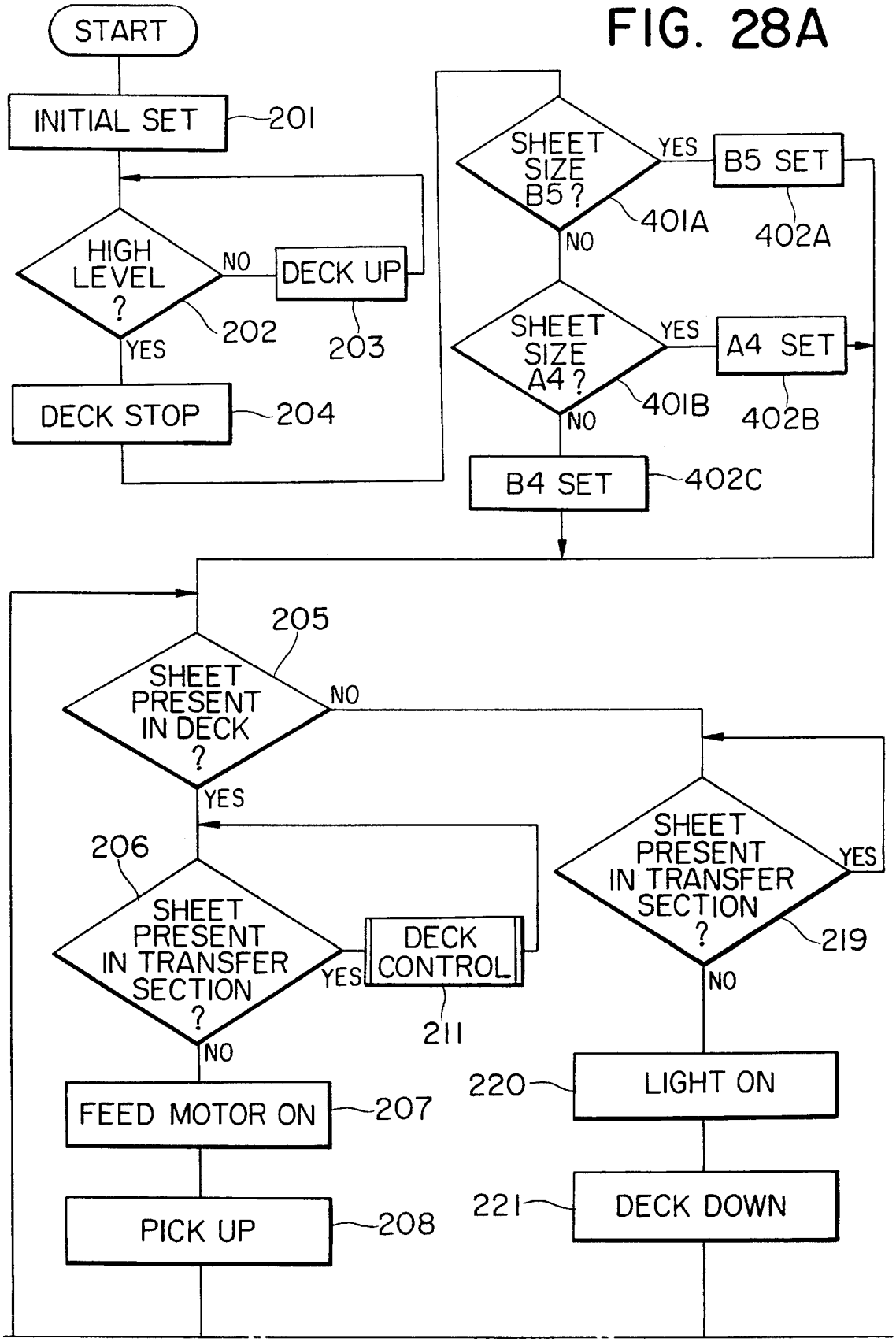
FIG. 28, composed of FIGS. 28A and 28B, and FIG. 29 are flow charts of the control program of the circuit shown in FIG. 27.
Figure 28B:
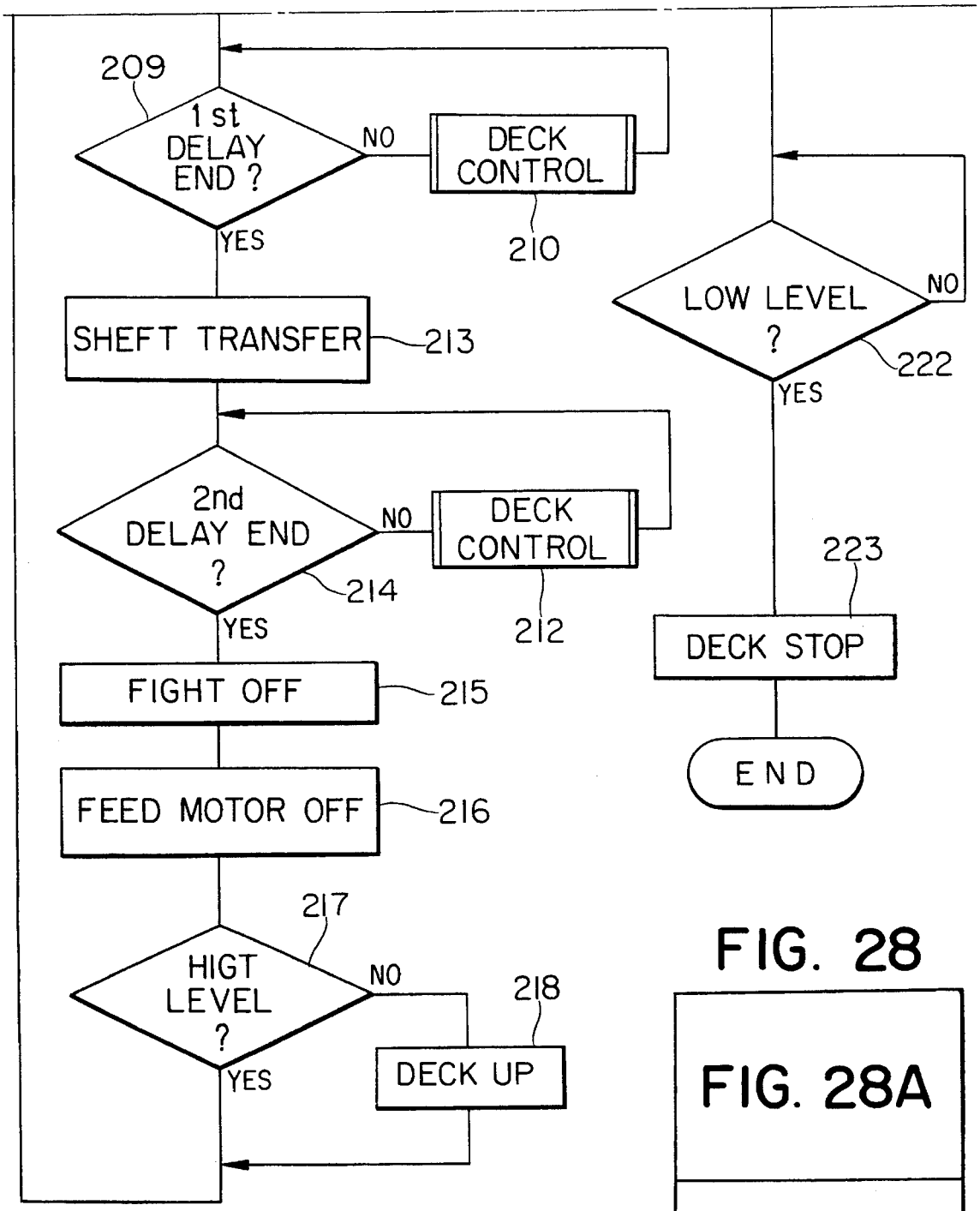
Figure 28:
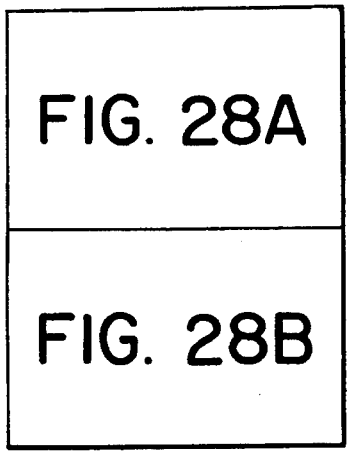

In step 201 in FIG. 28, the microcomputer 125 is initially set. Then, the output port $PE_3$ of the microcomputer 125 is set at high level, a lamp 126 is turned on, and the printer main body determines that there is no paper sheet left on the deck 101. In step 202, a detection signal from the level sensor 109 is supplied to the input port $PA_1$ so as to discriminate if the uppermost paper sheet is at a predetermined position. Initially, the deck 101 is at its lowermost position. Therefore, the flow advances to step 203. In step 203, an OFF signal for a relay 128 is produced from the output port $PF_0$ so as to move the deck 101 upward. For example, when the relay 128 is connected to the output port $PF_0$ through a hammer driver 129, a signal of low level is produced from the output port $PF_0$ so as to turn off the relay 128. Then, preparation for applying a power source voltage of +24 V to a terminal 102A of a lifter motor 102, and applying a GND potential of 0 V to a terminal 102B thereof is completed. In the initial period, an OFF signal for a relay 130 connected to the output port $PF_1$ is produced therethrough via a hammer driver 131. Then, the lifter motor 102 is kept stationary irrespective of the output from the output port $PF_0$. This is because the motor 102 cannot rotate since no voltage is applied to the motor 102. When an ON signal is then supplied to the relay 130 through the output port $PF_1$, a voltage of +24 V is applied to the terminal 102A of the motor 102, and a voltage of 0 V is applied to the terminal 102B thereof. Then, the deck 101 starts to move upward. Since step 203 forms a loop, the flow returns to step 202. When the deck 101 moves upward and the paper sheet is urged against the level sensor 109 with a predetermined pressure, the control flow advances to step 204.

In step 204, an OFF signal for the relay 130 is produced through the output port $PF_1$. Then, the rotation of the motor 102 is stopped.

When the deck 101 stops at a correct position, the paper sheet is sandwiched between the deck 101 and the paper holders 502Z. Then, those of the sensors 502A, 502B and 502C which are in contact with the paper sheet alone are turned on. The data obtained from the sensors is supplied to the microcomputer 125 through its input ports $PB_0$, $PB_1$ and $PB_2$.

When it is determined in step 401A that the paper size is B5, the flow goes to step 402A. Similarly, when the paper size is determined to be A4, the flow goes to step 402B. When the paper size is neither A4 nor B5, the flow goes to step 402C.

When the sensors 502A, 502B and 502C comprise microswitches which are turned on upon detecting a paper sheet, the paper size is determined to be B5 when the input data to the input ports $PB_0$, $PB_1$ and $PB_2$ are low, high and high. The paper size is determined to be A4 when the input data to the input ports $PB_0$, $PB_1$ and $PB_2$ are low, low and high. When all the input data are low, the paper size is determined to be B4.

In step 402A, the output ports $PF_2$ and $PF_3$ are set at high and low levels, respectively. Then, a plunger 501AP attracts the lever 501AL, while the lever 501BL remains separated. When the paper feeding device is mounted on the printer main body 203 in this state, the microswitch 405A is not pressed but the microswitch 405B alone is pressed. Accordingly, the printer main body can determine that the paper size is B5. In step 402B, the output ports $PF_2$ and $PF_3$ are set at low and high levels, respectively. In step 402C, the output ports $PF_2$ and $PF_3$ are kept at low level, respectively. The flow goes to step 205 after steps 402A, 402B and 402C.

In step 205, the state of a paper sensor 132 connected to the input port $PA_0$ is tested. If there is a paper sheet remaining on the deck 101, the sensor 132 is turned off. Otherwise, the sensor 132 is turned on. This may be accomplished with a microswitch and a deck or the like having a hole at a position corresponding to the microswitch. Since there is a paper sheet on the deck 101 now, the flow goes to step 206

In step 206, the state of a paper sensor 110 on the transfer path is checked. Since there is no paper sheet initially, the flow goes to step 207. In step 207, a signal of high level is produced from the output port $PE_0$ to turn on a hammer driver 133. As a result, a transistor 134 is turned on to rotate a transfer motor 111. However, since one-rotation clutches 118 and 120 are prevented from rotating by plungers 135 and 136, the transfer system is still not moving.

In step 208, the output port $PE_1$ is set at high level. Then, a hammer driver 137 is turned on, the plunger 135 is attracted, and the outer ring of the clutch 118 is removed. Then, the clutch 118 starts rotating, and the paper sheet is fed in the manner as has been described earlier. Subsequently, the output port $PE_1$ is set at low level, and the plunger 135 is returned. However, as described above, the clutch 118 does not stop before it completes one rotation.

In step 209, it is waited until the paper sheet reaches paired transfer rollers 119A and 119B. The delay time for this may be determined in the following manner. For example, a slotted disc 138 is mounted on the transfer motor 111. The disc 138 is sandwiched between the ports a photointerruptor 139. An output from the photointerruptor 139 is connected to an input port INT of the microcomputer 125. Changes in the output from the photointerruptor 139 are counted to determine the delay time. During the delay time in step 209, step 210 is executed.

Figure 29:
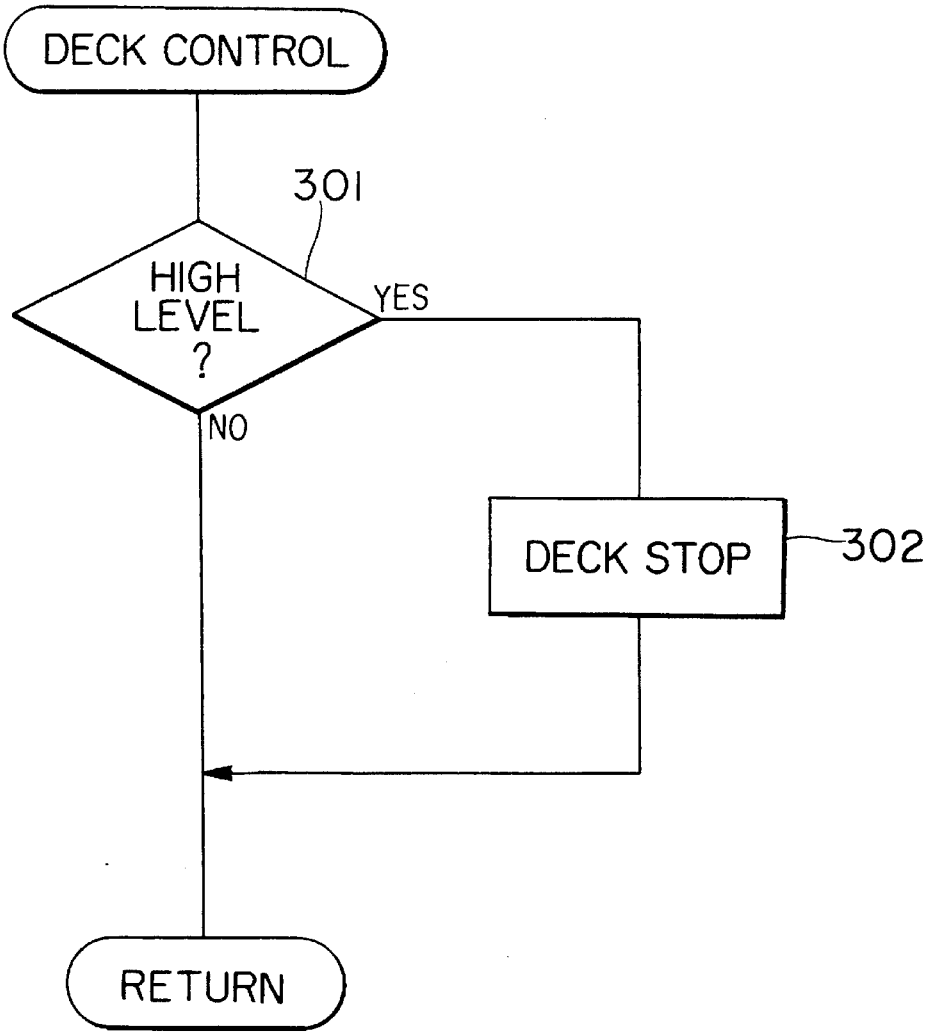

In deck control of step 210, as shown in FIG. 29, it is discriminated in step 301 if the deck 101 has moved upward and is in contact with the level sensor 109. If YES in step 301, the rotation of the lifter motor 102 is stopped in step 302. When a predetermined number of paper sheets are not remaining on the deck after feeding a paper sheet onto the transfer path, no subsequent paper sheet can be fed before the deck 101 is moved upward to reach the predetermined position. Then, the no paper state occurs.

In order to prevent this, in step 218 to be described later, the deck 101 is moved upward. The stopping timing of the deck 101 is monitored and controlled in steps 210, 211 and 212. When the on/off timing of the plunger must be delayed in step 208 or the like, the deck control program as shown in FIG. 29 may be executed. Steps 211 and 212 are the same and will not be described.

When the paper sheet contacts the paired transfer rollers 119A and 119B, a signal of high level is produced from the output port $PE_2$ in step 213. Then, a hammer driver 140 drives the plunger 136 so as to remove the outer ring of the clutch 120. In this manner, the transfer rollers 119A and 119B are rotated, the paper sheet is fed onto the transfer path, and the feed preparation of the paper sheet to the printer main body is completed. This is the same as the case of step 208. More specifically, even if a signal of low level is produced from the output port $PE_2$ so as to turn off the plunger 136, the one-rotation clutch 120 is rotated once. Accordingly, the paper sheet is fed to a predetermined position.

In step 214, it is waited until the paper sheet reaches the predetermined position. The deck control similar to that in step 209 is performed. When the paper sheet reaches the predetermined position, the lamp 126 is turned off (output port $PE_3$) in step 215. Then, the photosensor 209 mounted on the printer main body no longer receives light, and the main body can pick up the paper sheet at any time.

In step 216, the output port $PE_0$ is set at low level so as to stop the rotation of the transfer motor 111. In step 217, it is checked if the height of the deck 101 is suitable or not by means of the level sensor 109. When the height is too low, step 218 is executed.

Step 218 is similar to step 203 described above and drives the lifter motor 102 so as to move the deck 101 upward. Then, the lifter motor 102 is not stopped in the next step, but the flow returns to step 205. Thereafter, since the upward level of the deck 101 is monitored in each step, the uppermost paper sheet is kept at a constant level. In steps 206 and thereafter in the second control cycle, it is waited until all the paper sheets on the transfer path are picked up and there is no more paper sheet on the transfer path.

When there are no more sheet on the deck 101, the flow advances from step 205 to step 219. When the printer main body picks up the paper sheet and there is no paper sheet on the transfer path, the flow advances to step 220. Then, the lamp 126 is turned on, light is irradiated on a photosensor 209, and the printer main body 203 detects the no paper state.

In step 221, a signal of high level is produced through the output port $PF_0$ to drive the relay 128 and to switch its contact. Then, the output port $PF_1$ is set at high level to drive the relay 130 and to close its contact. Then, a voltage of 0 V is applied to the terminal 102A of the lifter motor 102, while a voltage of 24 V is applied to the terminal 102B thereof, so that the motor 102 starts rotating to move the deck 101 downward.

In step 222, it is waited until a level sensor 141 mounted at the lower portion of the printer main body detects the lowermost level of the deck 101. In the following step 223, a signal of low level is produced through the output port $PF_1$ so as to stop the rotation of the lifter motor 102. Preparation of paper sheet replenishment is completed, and the control program is ended.

The mode of operation of the device is as described above.

Figure 30:
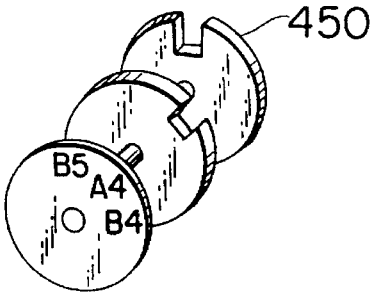
FIG. 30 shows the configuration of a paper size signal transmission mechanism according to still another embodiment of the present invention.
Figure 31:
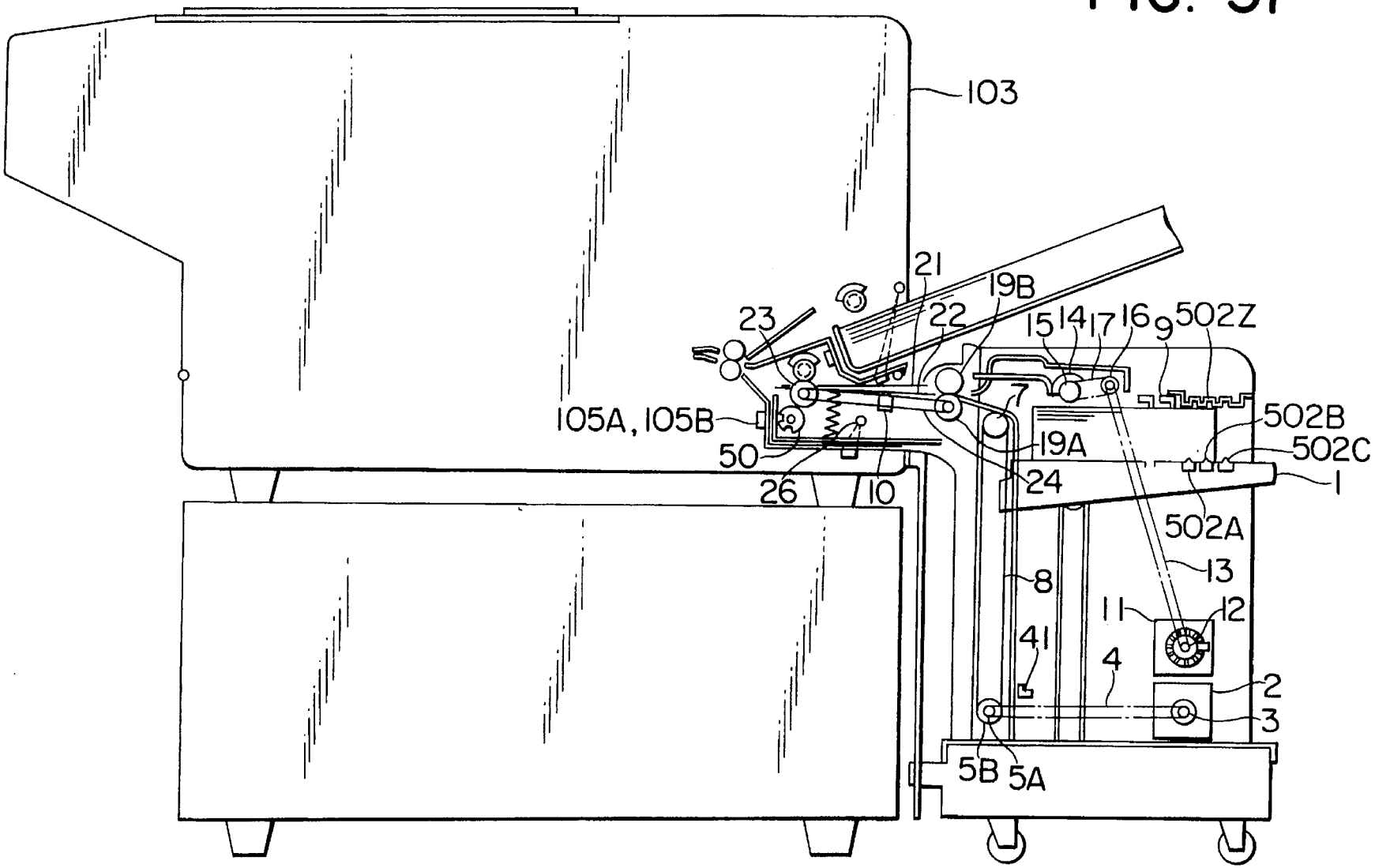
FIG. 31 shows the internal construction of a paper feeding device according to still another embodiment of the present invention.

In the embodiments described above, the paper size signal transmission mechanism comprises a plunger and a lever. However, the paper size signal transmission mechanism may have any other configuration as long as it can control the connection of a group of size detection switches 405. For example, a cam 450 as shown in FIG. 30 is mounted on the distal end of the transfer path as shown in FIG. 31. Then, the cam 450 is switched in accordance with signals from the sensors 502A to 502C so as to switch the on/off state of the switches 405. A sensor for detecting the size of the paper sheet on the deck 101 may have any configuration.

In summary, paper size data may be automatically transmitted to a recording apparatus main body such as a printer main body in accordance with the paper size. Accordingly, manual operation in accordance with the paper size need not be performed, thereby providing a paper feeding device which can readily work with the main body.

Although the above embodiments have been described with reference to a case of a paper feeding device of vertically movable type, the present invention is not limited to such devices. Various changes and modifications may be made within the spirit and scope of the present invention.

What is claimed is:

1. A sheet feeding device comprising:

storage means for storing sheets;

feeding means for feeding a sheet from said storage means;

transfer means for transferring the sheet fed by said feeding means along a transfer path to a predetermined position; and control means for controlling said transfer means in such a manner as to stop the transferred sheet at said predetermined position, wherein said control means releases activation of said transfer means in different timings in accordance with different sheet sizes so that the sheet stops at said predetermined position.

2. A device according to claim 1, wherein said transfer means comprises signal generating means for generating a clock signal in accordance with a transfer operation thereof, and said control means releases activation of said transfer means upon counting a predetermined number of clock signals.

3. A device according to claim 2, wherein the predetermined number of clock signals changes in accordance with the sheet size.

4. A device according to claim 2, wherein said control means starts counting the clock signals upon detecting the sheet at a first position on the transfer path, which position is located upstream from said predetermined stop position with respect to the transfer direction of the sheet.

5. A sheet feeding device attachable to and detachable from an image forming apparatus which has on a cassette attachment section thereof first size detecting means for detecting a sheet size of sheets stored in the cassette and first feeding means adapted to engage with said cassette attachment section for feeding a sheet fed from the cassette, said sheet feeding device comprising:

storing means for storing sheets, said storing means being capable of storing different sizes of sheets;

second size detecting means for detecting a size of the sheets stored in said storing means;

second feeding means for feeding one by one the sheets stored in said storing means and transferring the sheet to said first feeding means in said image forming apparatus when said sheet feeding device is attached to said cassette attachment section; and size transmission means for causing the first size detecting means to perform a size detecting operation when said sheet feeding device is attached to said cassette attachment section, wherein a state of said size transmission means is variable in accordance with the sheet size detected by said second size detecting means.

6. An overrun detection device comprising:

detecting means for detecting an overrun of a movable member;

signal output means for outputting a predetermined signal when said detecting means detects an overrun while said movable member is moved in a specific direction; and inhibiting means for inhibiting said signal output means from outputting said predetermined signal, even if said detecting means has been operated, while said movable member is being moved in a direction different from said specific direction.

7. A device according to claim 6, wherein said inhibiting means comprises a switching element, and said switching element is operable to maintain an output of said signal output means constant while said movable member is moved in a direction different from said specific direction.

8. A device according to claim 7, wherein said switching element is connected in parallel with said detecting means.

9. A device according to claim 7 or 8, wherein said switching element comprises a diode.

10. A device according to claim 6, wherein said movable member comprises a lifter which vertically moves in a paper feeding device.

* * * * *

UNITED STATES PATENT AND TRADEMARK OFFICE

CERTIFICATE OF CORRECTION

PATENT NO. : 5,480,131

DATED : January 2, 1996

INVENTOR(S) : HIDEAKI FURUKAWA, ET AL.

It is certified that error appears in the above-indentified patent and that said Letters Patent is hereby corrected as shown below:

On the title page, item [30]

line FAPD, "Jan. 25, 1982 [JP] Japan .... 57-187181" and "Jan. 25, 1982 [JP] Japan .... 54-187182" should read --Oct. 25, 1982 [JP] Japan .... 57-187181--, and --Oct. 1982 [JP] Japan .... 57-187182--, respectively.

IN THE DRAWINGS

Figure 23A,

"HIGT" should read --HIGH--.

Figure 23B,

MOTR" should read --MOTOR--, and "HIGT" should read --HIGH--.

Figure 28B,

"SHEFT" should read --SHEET--, "FIGHT" should read --LIGHT--, and "HIGT" should read --HIGH--.

Column 1, line 55, "(fed or picked up" should read --("fed" or "picked up",--; and line 58, "or" should be deleted.

Column 7, line 26, "10" should be deleted; and line 41, "$0_6 0_7 0_6$" should read --$0_7$ and $0_6$--.

Column 8, line 56, "10" should be deleted.

Column 10, line 39, "sensor 1 (806)" should read --sensor 806--; and line 40, "0N" should read --ON--.

UNITED STATES PATENT AND TRADEMARK OFFICE

CERTIFICATE OF CORRECTION

PATENT NO. : 5,480,131

DATED : January 2, 1996

INVENTOR(S) : HIDEAKI FURUKAWA, ET AL.

It is certified that error appears in the above-indentified patent and that said Letters Patent is hereby corrected as shown below:

Column 11,
line 37, "0N" should read --ON--.
Column 13,
line 5, "the paper" should read --the second paper--;
line 25, "(step 1086) o" should read --(step 1086).--;
line 26, "(step 1076-N," should read --(step 1076-N),--; and
line 52, "24" should read --+24--.
Column 14,
line 5, "6aof" should read --6a of--.
Column 23,
line 42, "step 206" should read --step 206.--; and
line 64, "ports" should read --parts of--.
Column 24,
line 53, "sheet" should read --sheets--.

Signed and Sealed this

Eleventh Day of June, 1996

*Attest:*

Bruce Lehman

BRUCE LEHMAN

*Attesting Officer*

*Commissioner of Patents and Trademarks*